US008240466B2

(12) United States Patent
Meador, III

(10) Patent No.: US 8,240,466 B2
(45) Date of Patent: Aug. 14, 2012

(54) PAPERBOARD MEDIA PACKAGE

(76) Inventor: William Edward Meador, III, Lexington, KY (US)

( * ) Notice: Subject to any disclaimer, the term of this patent is extended or adjusted under 35 U.S.C. 154(b) by 202 days.

(21) Appl. No.: 12/671,799

(22) PCT Filed: Aug. 21, 2008

(86) PCT No.: PCT/US2008/009946

§ 371 (c)(1),
(2), (4) Date: Feb. 2, 2010

(87) PCT Pub. No.: WO2009/025834

PCT Pub. Date: Feb. 26, 2009

(65) Prior Publication Data

US 2011/0036734 A1 Feb. 17, 2011

Related U.S. Application Data

(60) Provisional application No. 61/052,287, filed on May 12, 2008, provisional application No. 60/957,384, filed on Aug. 22, 2007.

(51) Int. Cl.
*B65D 85/57* (2006.01)

(52) U.S. Cl. ..... 206/308.1; 206/312

(58) Field of Classification Search ..... 206/308.1, 206/232, 307, 308.2, 311, 312, 493
See application file for complete search history.

(56) References Cited

U.S. PATENT DOCUMENTS 4,325,507 A 4/1982 Janhomen
4,327,831 A 5/1982 Inaba et al.
4,473,153 A 9/1984 Colangelo
4,709,812 A * 12/1987 Kosterka ..... 206/308.1
4,925,023 A 5/1990 Goldblatt et al.
5,048,681 A 9/1991 Henkel
5,154,284 A 10/1992 Starkey
5,219,417 A 6/1993 O'Brien et al.
5,236,081 A 8/1993 Fitzsimmons et al.
5,248,032 A 9/1993 Sheu et al.
5,289,918 A * 3/1994 Dobias et al. ..... 206/312
5,332,089 A 7/1994 Tillett et al.
5,333,728 A 8/1994 O'Brien et al.
5,366,074 A 11/1994 O'Brien et al.
5,421,453 A 6/1995 Harrer et al.
5,425,488 A 6/1995 Thompson
5,450,953 A 9/1995 Reisman
5,613,612 A * 3/1997 Davault ..... 206/768
5,662,217 A 9/1997 Durr
5,730,283 A 3/1998 Lax
5,772,022 A * 6/1998 Renna ..... 206/312

(Continued)

OTHER PUBLICATIONS

StoraEnso, DBS Disc Box Slider, 2 pgs., date unknown.

(Continued)

*Primary Examiner* — Steven A. Reynolds
(74) *Attorney, Agent, or Firm* — King & Schickli, PLLC

(57) ABSTRACT

A paperboard media package is provided for at least one media disc. The media package includes a front cover, a rear cover, a spine connecting the front cover to the rear cover, at least one media well carried by one of the front cover and a rear cover and a lock. The lock is displaceable between a locked position wherein the lock engages the media disc(s) to positively secure the media disc(s) in the media well(s) when the media package is closed and an unlocked position wherein the media disc(s) may be freely removed from the media well(s) when the media package is open.

18 Claims, 27 Drawing Sheets

U.S. PATENT DOCUMENTS

| | | | | |
|---|---|---|---|---|
| 5,788,069 | A | 8/1998 | Calhoun, III et al. | |
| 5,790,265 | A | 8/1998 | Shikakura | |
| 5,803,250 | A * | 9/1998 | Mori | 206/308.1 |
| 5,819,928 | A | 10/1998 | Wynalda, Jr. | |
| 5,823,333 | A * | 10/1998 | Mori | 206/308.1 |
| 5,884,761 | A | 3/1999 | Gelardi et al. | |
| 5,894,924 | A | 4/1999 | Koch | |
| 5,901,843 | A | 5/1999 | Gambardella et al. | |
| 5,921,386 | A | 7/1999 | Smith | |
| 5,944,183 | A | 8/1999 | Powland et al. | |
| 6,016,908 | A | 1/2000 | Gaetano | |
| 6,092,650 | A * | 7/2000 | Budnik | 206/232 |
| 6,189,689 | B1 | 2/2001 | Toussaint | |
| 6,241,085 | B1 | 6/2001 | Koehn | |
| 6,398,024 | B2 | 6/2002 | Koehn | |
| 6,494,319 | B2 * | 12/2002 | Collins | 206/308.1 |
| 6,612,433 | B2 | 9/2003 | McKenzie | |
| 6,629,600 | B2 * | 10/2003 | Cinquina | 206/312 |
| 6,637,588 | B1 | 10/2003 | Stamer | |
| 6,783,000 | B1 * | 8/2004 | Price et al. | 206/308.1 |
| 7,028,835 | B1 | 4/2006 | Rajter et al. | |
| 7,080,731 | B2 | 7/2006 | O'Brien et al. | |
| 7,104,396 | B2 | 9/2006 | Marsilio et al. | |
| 7,117,992 | B2 | 10/2006 | Westmeyer et al. | |
| 7,267,226 | B2 * | 9/2007 | Cananzey | 206/312 |
| 7,780,001 | B2 * | 8/2010 | Seko | 206/312 |
| 2001/0015328 | A1 * | 8/2001 | Collins | 206/308.1 |
| 2002/0020643 | A1 * | 2/2002 | Kleine-Moellhoff | 206/310 |
| 2002/0125153 | A1 * | 9/2002 | Cinquina | 206/308.1 |
| 2003/0000854 | A1 * | 1/2003 | Jang | 206/308.1 |
| 2004/0031709 | A1 * | 2/2004 | Taw et al. | 206/312 |
| 2006/0163090 | A1 * | 7/2006 | Sugiyama | 206/308.1 |
| 2006/0196789 | A1 * | 9/2006 | O'Brien | 206/308.1 |
| 2008/0017536 | A1 * | 1/2008 | Wynalda et al. | 206/308.1 |

OTHER PUBLICATIONS

AGI Media, ecoClick, 1 pg., date unknown.
NAPCO, ECOtray, 1 pg., date unknown.
Paramount, 2 pgs., date unknown.
Shorewood, Flip-Pak, 1 pg., date unknown.
Warner Bros., 2 pgs., date unknown.

* cited by examiner

PAPERBOARD MEDIA PACKAGE

This application is a 371 of PCT/US08/09946 filed on 21 Aug. 2008 which claims the benefit of U.S. Provisional Patent Application Ser. Nos. 60/957,384 filed on 22 Aug. 2007 and 61/052,287 filed on 12 May 2008.

TECHNICAL FIELD

The present invention relates generally to the packaging field and, more particularly, to a media package of all paperboard construction.

BACKGROUND OF THE INVENTION

Boxes, containers and packages for holding media such as CD's and DVD's are well known in the art. Examples of such packages and containers are found in, for example, U.S. Pat. Nos. 5,819,928; 5,421,453; 5,366,074; 5,333,728; 5,248,032; 5,236,081; and 5,154,284. The prior art devices are generally constructed from plastic or plastic and paperboard. Typically a plastic component is provided to provide a lock for securing the media disc within the container.

The present invention relates to a one-piece, all paperboard media package. Advantageously, such a package may be made with recyclable paper, including 100% recycled paper. Further, all graphics are printed on one side of the board which is then formed into a rigid retail display package, or a generic consumer storage package. Advantageously, a lock, made from paperboard, is also provided to secure the media disc(s) in the package. As a result the entire package is biodegradable and environment friendly.

SUMMARY OF THE INVENTION

In accordance with the purposes of the present invention as described herein, a paperboard media package is provided for at least one media disc. The media package comprises a front cover, a rear cover, a spine connecting the front and rear cover and a media well carried by one of the front and rear cover. The media well is sized and shaped to receive and hold the media disc. In addition, the media package includes a lock. The lock is displaceable between (a) a locked position wherein the lock engages the media disc to positively secure the media disc in the media well when the media package is closed and (b) an unlocked position wherein the media disc may be freely removed from the media well when the media package is opened.

In one possible embodiment of the present invention the media package and the lock are both made from paperboard, which also can be 100% recycled paperboard. The lock comprises a folding locking tab connected between the front cover and the rear cover of the media package. In addition, the media well is formed from folded, radially arrayed flaps of paperboard.

The paperboard media package of the present invention may be alternatively described as comprising: (a) a media well panel including a media well, a first side wall and a first securing tab; (b) a second side wall panel connected to the media well panel by a first fold line; (c) a first cover panel connected to the second side wall panel by a second fold line; (d) a spine panel connected to the rear cover panel by a third fold line; (e) a second cover panel connected to the spine panel by a fourth fold line; and (f) a second cover panel support panel connected to the second cover panel by a fifth fold line. The second cover panel support panel includes a floating spine support and a second securing tab. The second cover panel support panel carries a locking flap that positively holds the media disc in the media well when the media package is closed.

More specifically, the locking flap includes a main fold line connecting the locking flap to the second cover panel support panel. In addition, the locking flap includes a first crease line, a second crease line and a third crease line. A locking support is formed between the main fold line and the first crease line. A locking tab is formed between the first and second crease lines. An extension section is formed between the second and third crease lines and a mounting section is connected to the extension section by the third crease line. The mounting section is secured to an inside face of the first cover panel.

The first side wall includes an opening and the locking flap extends through that opening and engages the media disc in the media well when the media package is closed. The spine support abuts the spine panel. The spine panel has a width $W_1$ and the locking support has a width $W_2$ between the main fold line and the first crease line where $W_1$ is greater than $W_2$.

The locking flap is displaceable between (a) a locked position wherein the locking tab engages the media disc to positively secure the media disc in the media well when the media package is closed and (b) an unlocked position wherein the media disc may be freely removed from the media well when the media package is opened. More specifically, the locking tab folds over-center about the third crease line when the second cover panel is moved from a fully opened position wherein the second cover is aligned with the first cover panel to a fully closed position wherein the second cover panel overlies the media well panel and the first cover panel.

The media package is secured together by the first and second securing tabs. More specifically, the first securing tab is secured to the second securing tab between the media well panel and the first cover panel. The first and second securing tabs remain unsecured to the media well panel and the first cover panel so as to allow efficient and effective operation of the lock when the media package is open and closed.

A top wall is connected to the first cover panel by a sixth fold line. In addition, a bottom wall is connected to the first cover panel by a seventh fold line. Further, the media well panel includes a series of radially arrayed flaps that are folded to form the media well. In addition, the media well panel includes at least one finger notch communicating with the media well to allow one to engage an edge of the media disc to extract the media disc from the media well. Finally, a paperboard reinforcement is received on the media well over the folded, radially arrayed flaps. The paperboard reinforcement fills the bottom of the media well and the at least one finger notch. The reinforcement is adhered to the bottom of the media well using any appropriate adhesive.

In the following description there is shown and described two different embodiments of the invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

Reference will now be made in detail to the present preferred embodiment of the invention, an example of which is illustrated in the accompanying drawings.

DETAILED DESCRIPTION OF THE INVENTION

Figure 1:
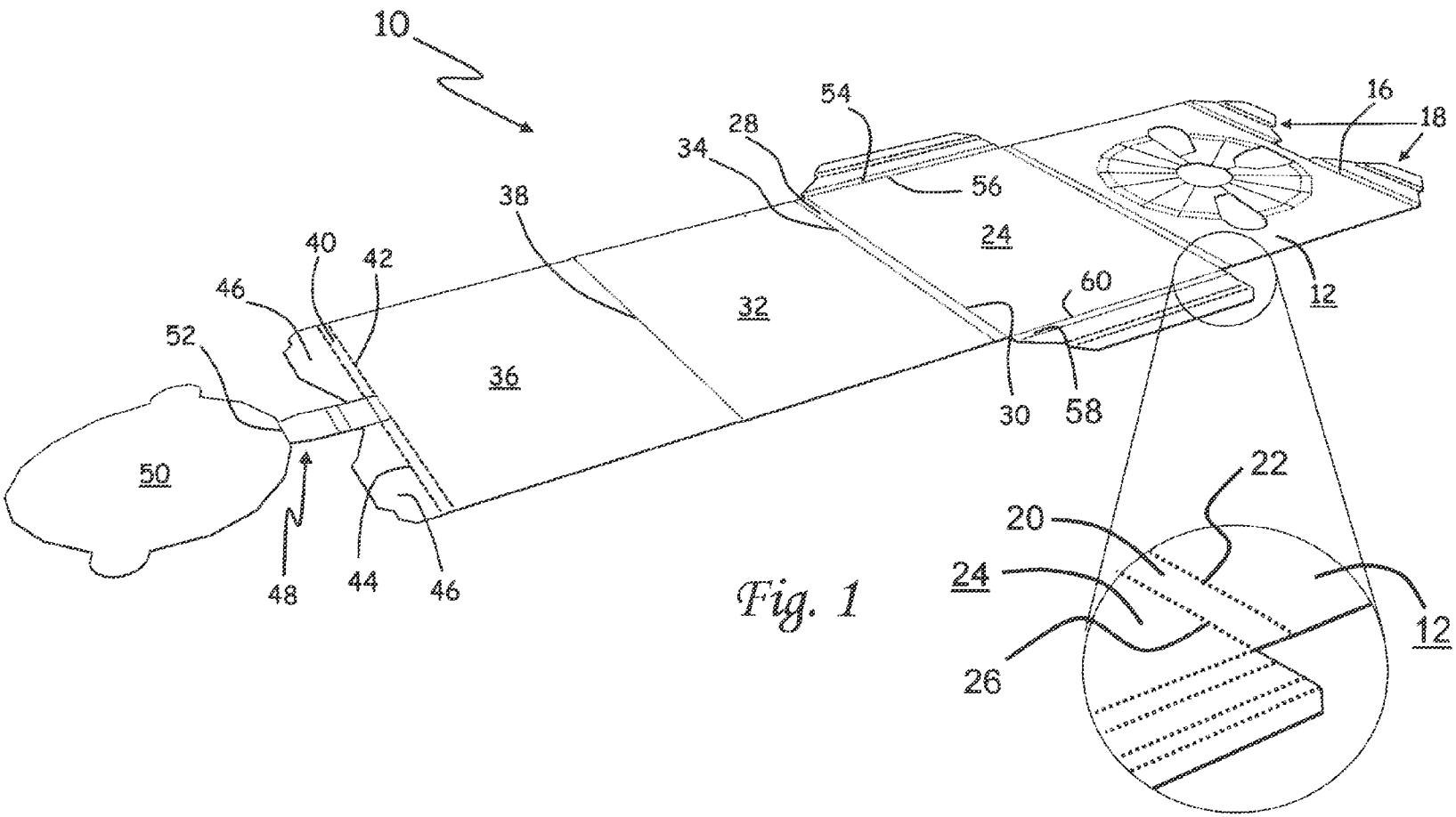
FIG. 1 is a perspective view of a paperboard blank from which it is possible to construct the media package of the present invention.
Figure 15:
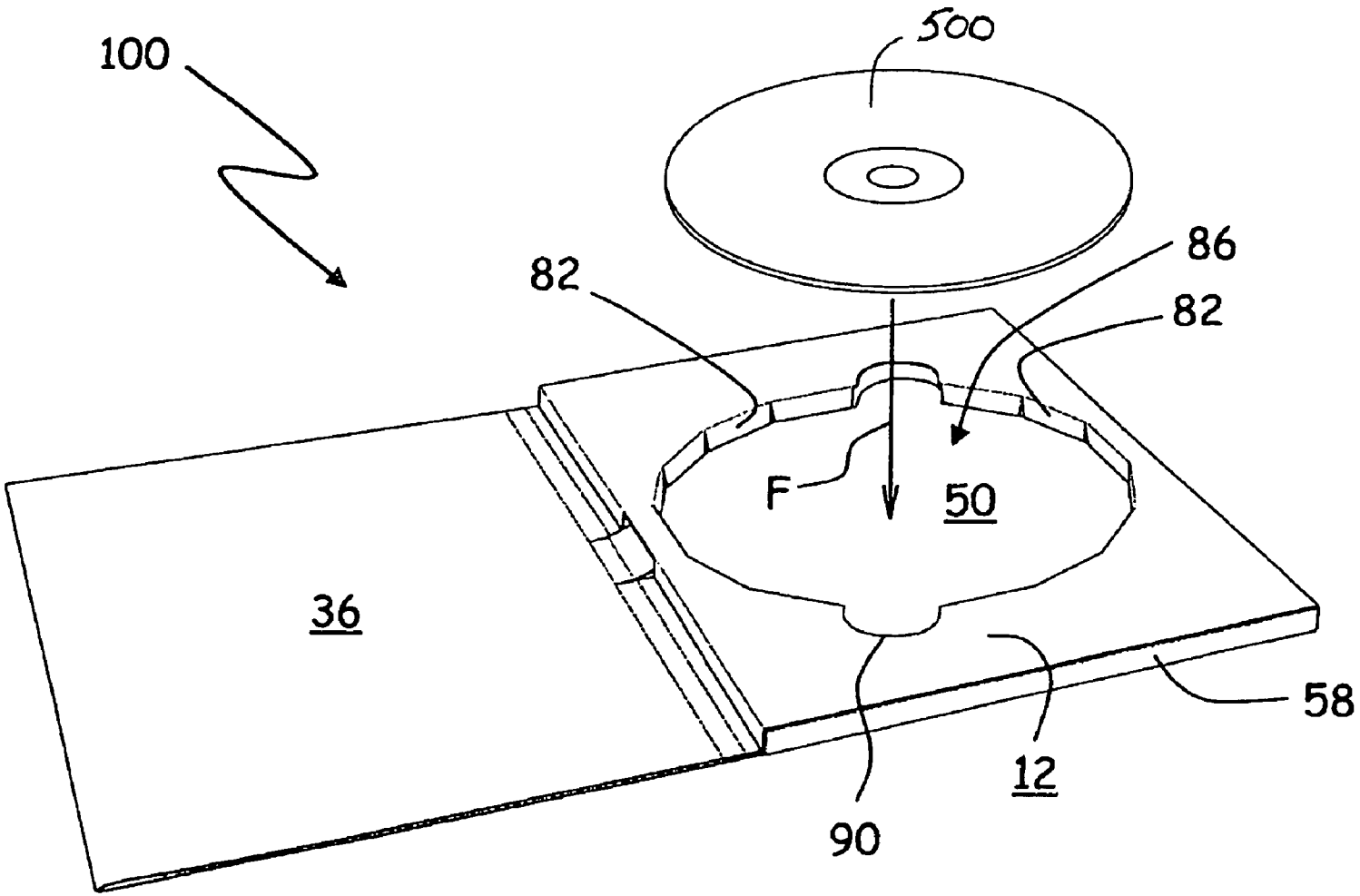
FIG. 15 is a perspective view illustrating the insertion of a media disc into the completed media package.

Reference is now made to FIG. 1 illustrating the paperboard blank 10 used to construct the media package 100 of the present invention illustrated in FIG. 15. As illustrated in FIG. 1, the paperboard blank 10 includes a media well panel 12 including a series of radially arrayed flaps 14 forming a starburst pattern, a first side wall 16 and a first securing tab 18. A second side wall panel 20 is connected to the media well panel 12 by a first fold line 22.

A first or rear cover panel 24 is connected to the second side wall panel 20 by a second fold line 26. A spine panel 28 is connected to the first cover panel 24 by a third fold line 30. A second or front cover panel 32 is connected to a spine panel 28 by a fourth fold line 34. In addition, a second cover panel support panel 36 is connected to the second cover panel 32 by the fifth fold line 38. The support panel 36 includes a floating spine support 40 defined between the nick perforation lines 42, 44, a second securing tab 46 and a locking flap generally illustrated by reference numeral 48. Finally, a media well reinforcement 50 is connected to the end of the locking tab 48 at the line 52.

As further illustrated in FIG. 1, a top wall 54 is connected to the first cover panel 24 at the fold line 56. A bottom wall 58 is connected to the first cover panel 24 at the fold line 60. The method of constructing the media package 100 from the paperboard blank will now be described in detail with reference to FIGS. 2-14.

Figure 2:
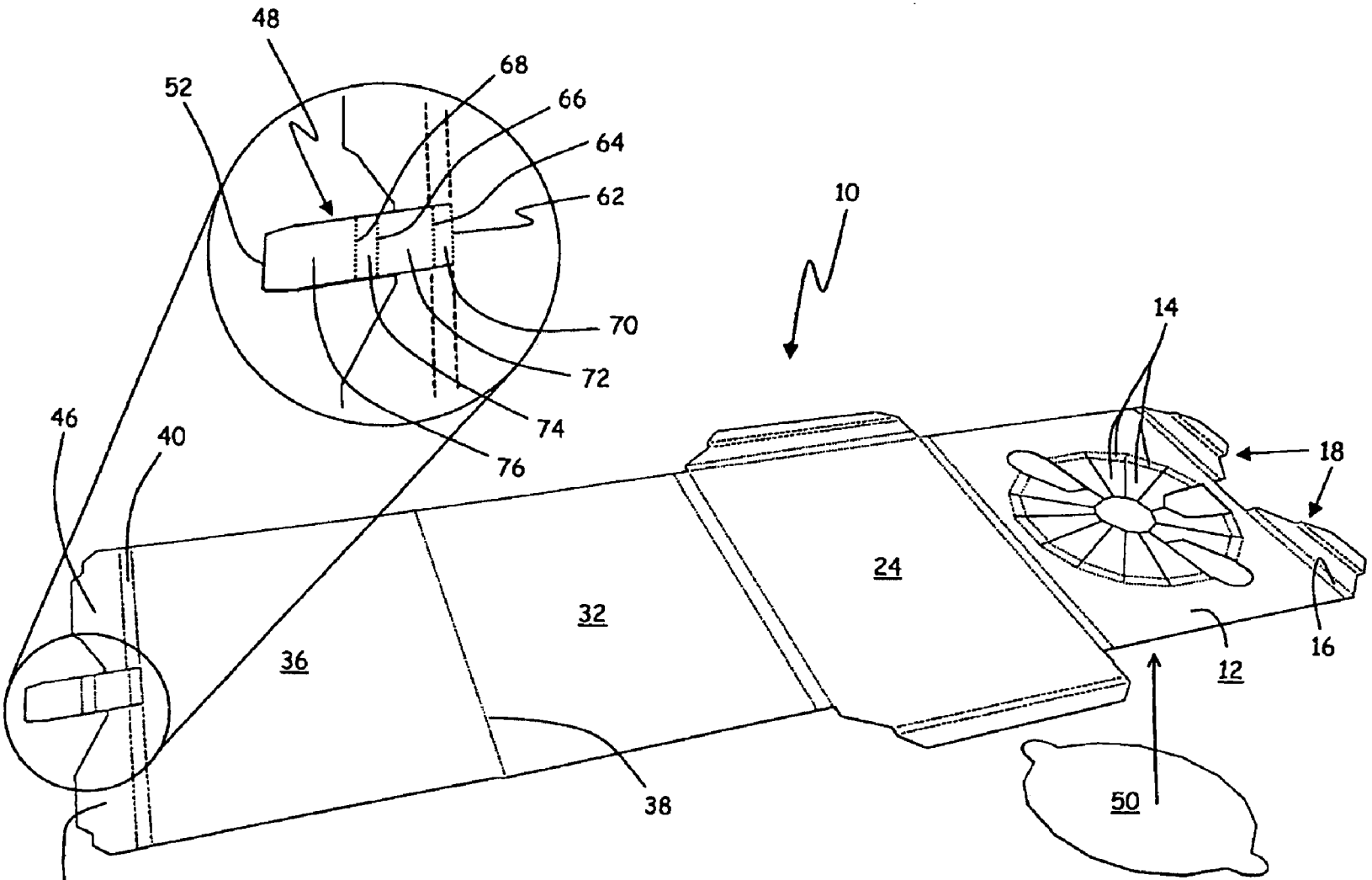
FIGS. 2-14 are perspective views providing step by step illustration of the construction of the media package from the paperboard blank illustrated in FIG. 1.
Figure 3:
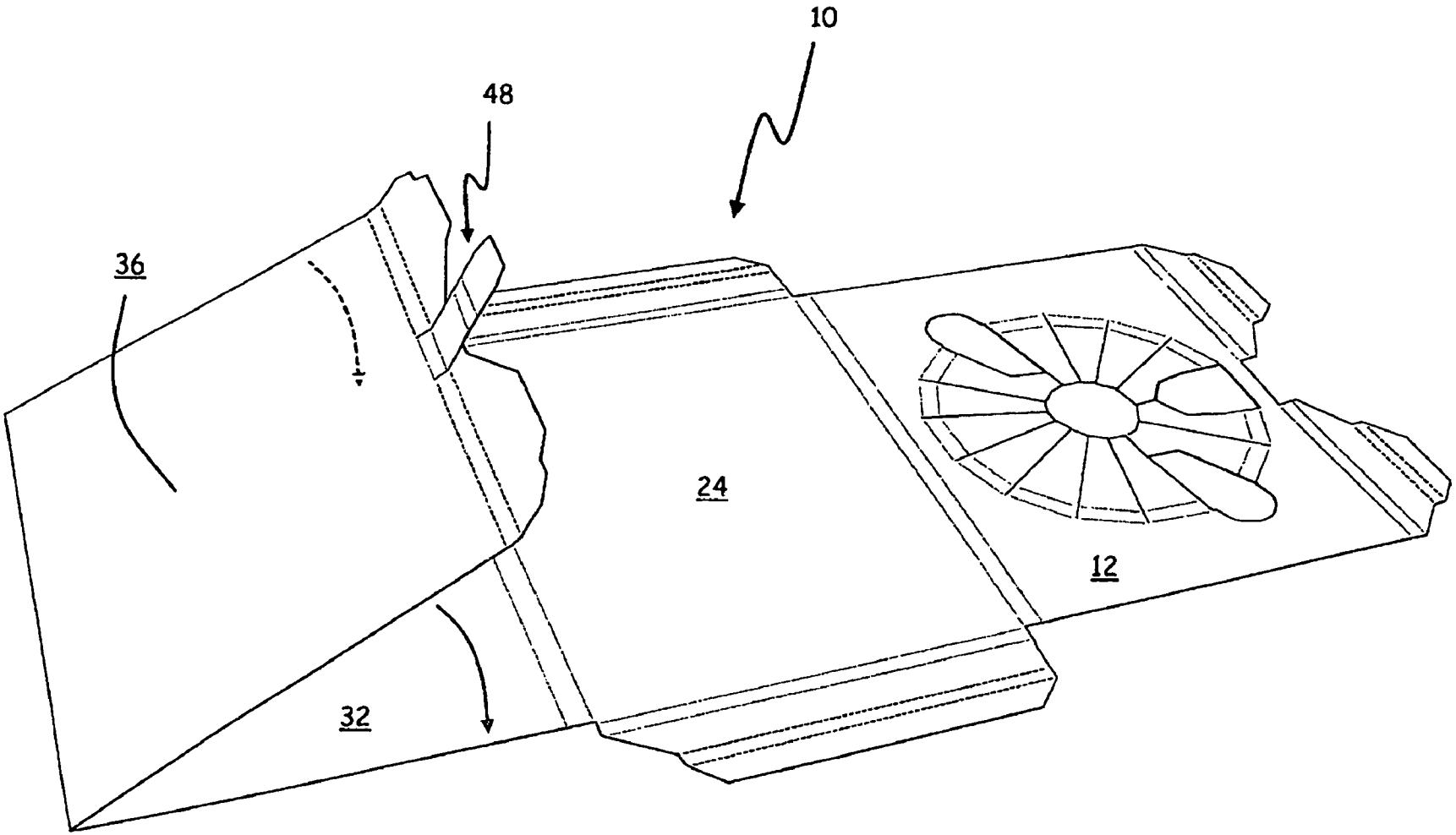

As illustrated in FIG. 2, first, the media well reinforcement 50 is removed from the locking flap 48 by cutting along the line 52 (see FIG. 2). Next, the blank 10 is folded at the fifth fold line 38 so that the support panel 36 overlaps and lies flush against the inside face of the second cover panel 32 (see FIGS. 2 and 3). An appropriate adhesive is applied between the second cover panel 32 and the support panel 36 to secure the panels in position.

Figure 4:
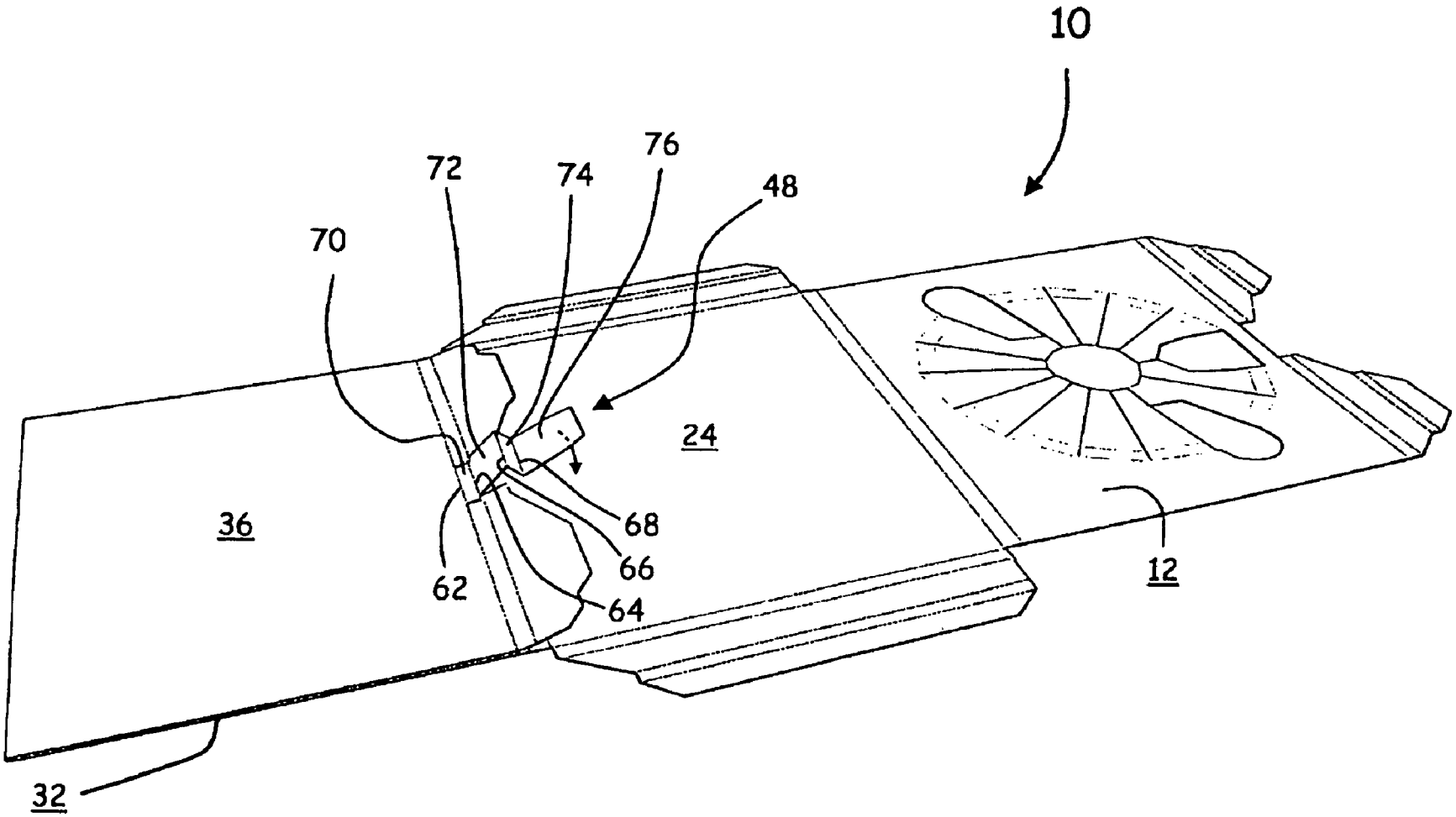

As illustrated in FIGS. 2 and 4, the locking flap 48 is connected to the support panel 36 by a main fold line 62. The locking flap 48 also includes a first crease line 64, a second crease line 66 and a third crease line 68. A locking support 70 is provided between the main fold line 62 and the first crease line 64. A locking tab 72 is provided between the first and second crease lines 64, 66. An extension section 74 is formed between the second and third crease lines 66, 68 and a mounting section 76 is connected to the extension section 74 by the third crease line 68.

Figure 5:
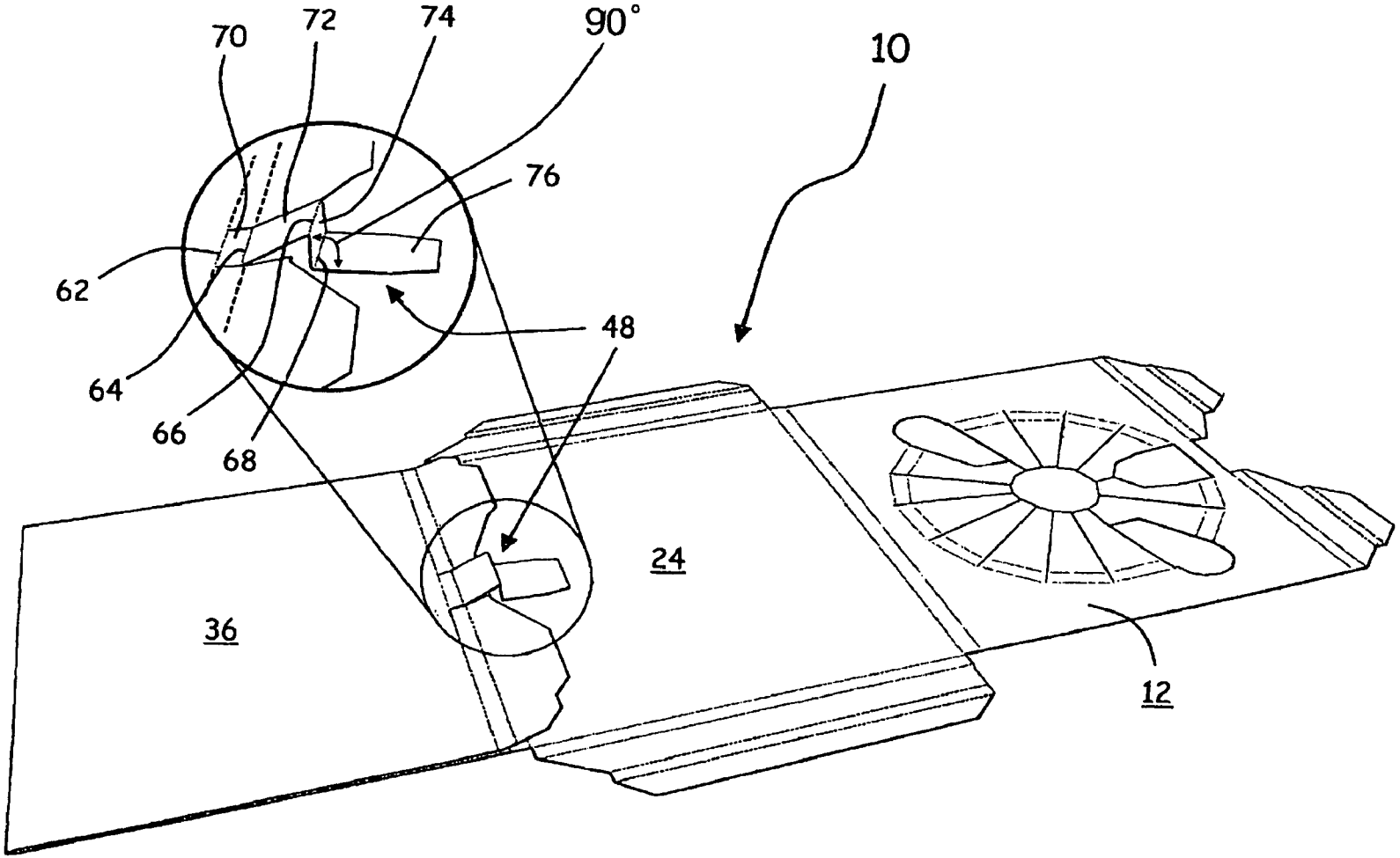
Figure 6:
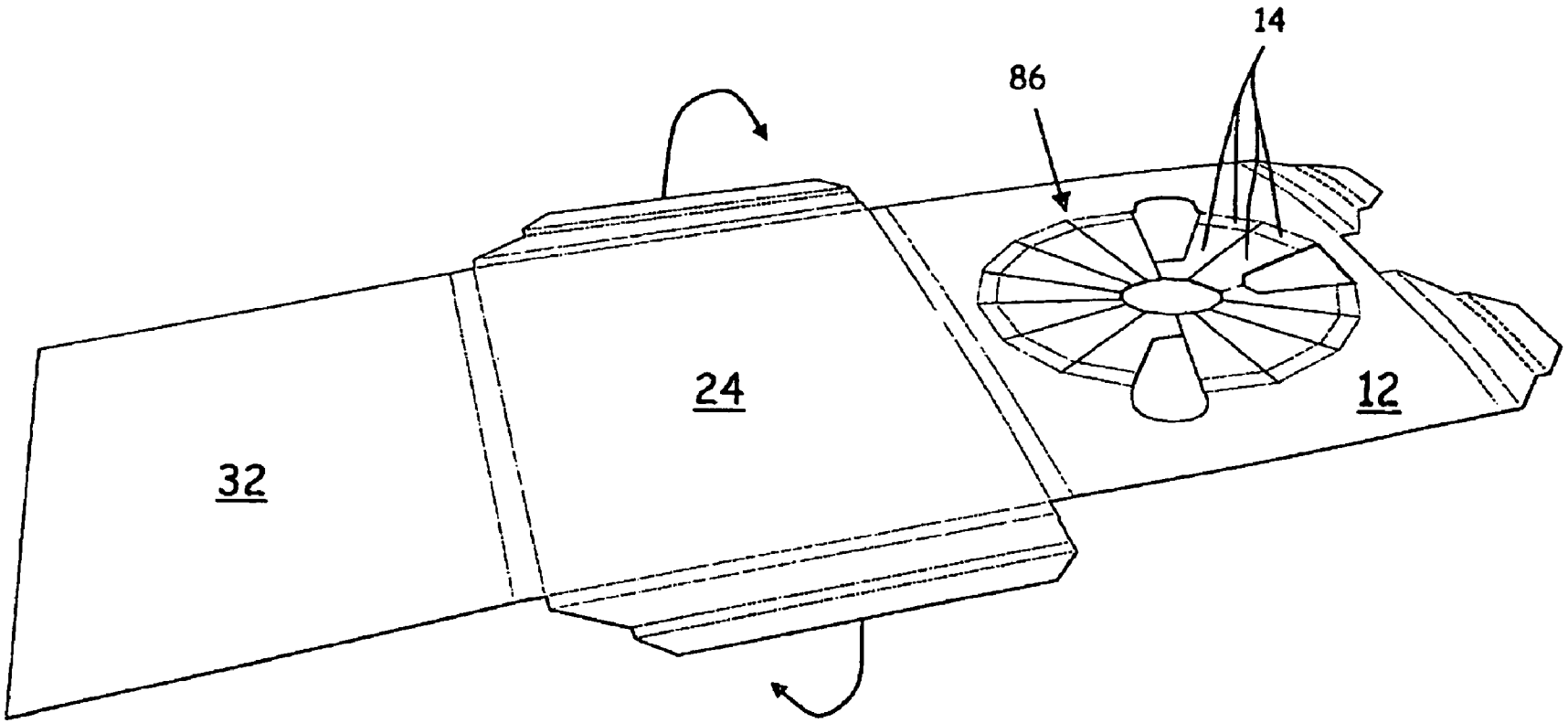

As best illustrated in FIGS. 4 and 5, the locking flap 48 is now folded along the crease lines 66, 68 and the mounting section 76 thereof is adhered to the inside face of the first cover panel 24 so that the extension section 74 of the locking flap 48 forms a ninety degree angle with the inside face of the first cover panel 24.

Figure 7:
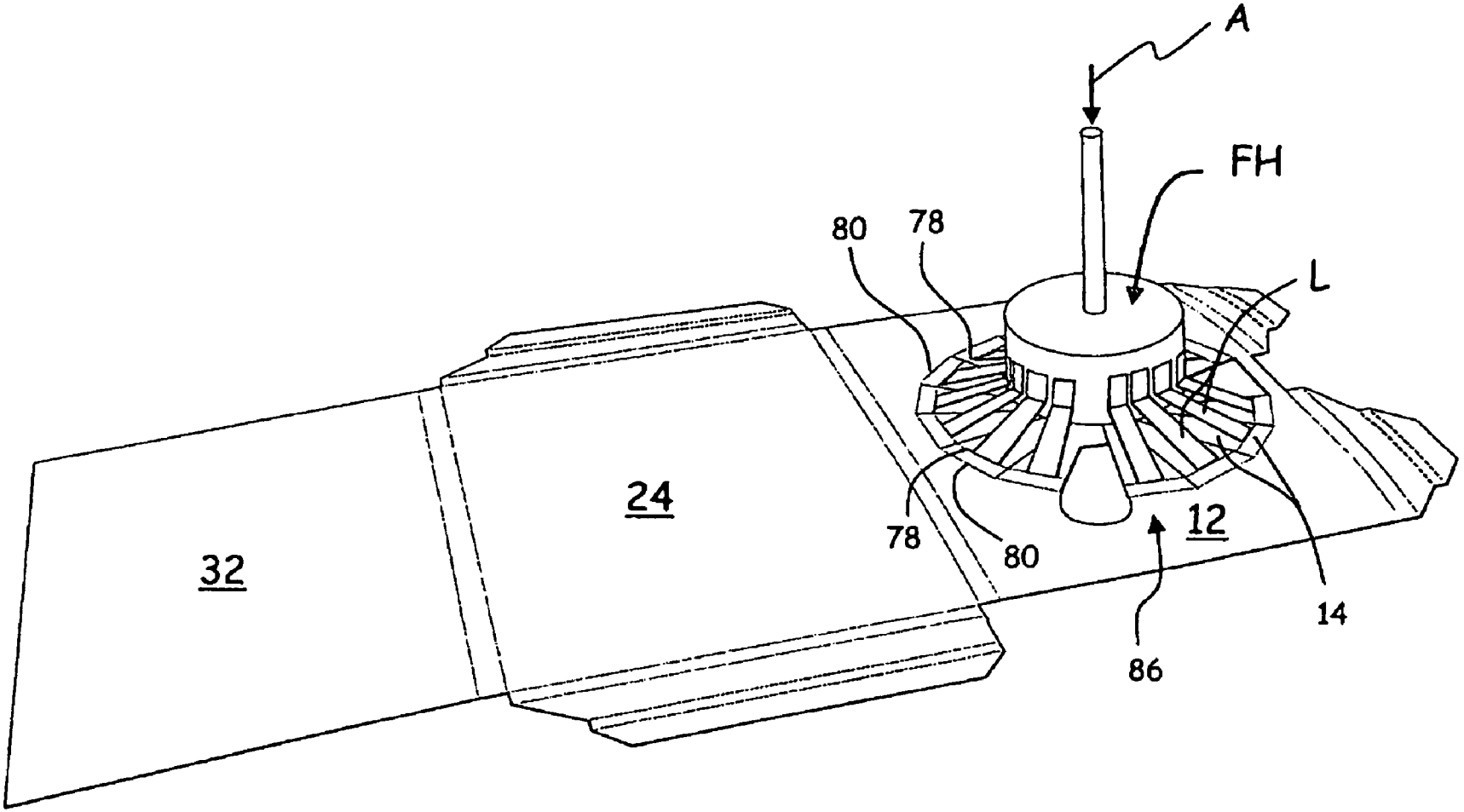
Figure 8:
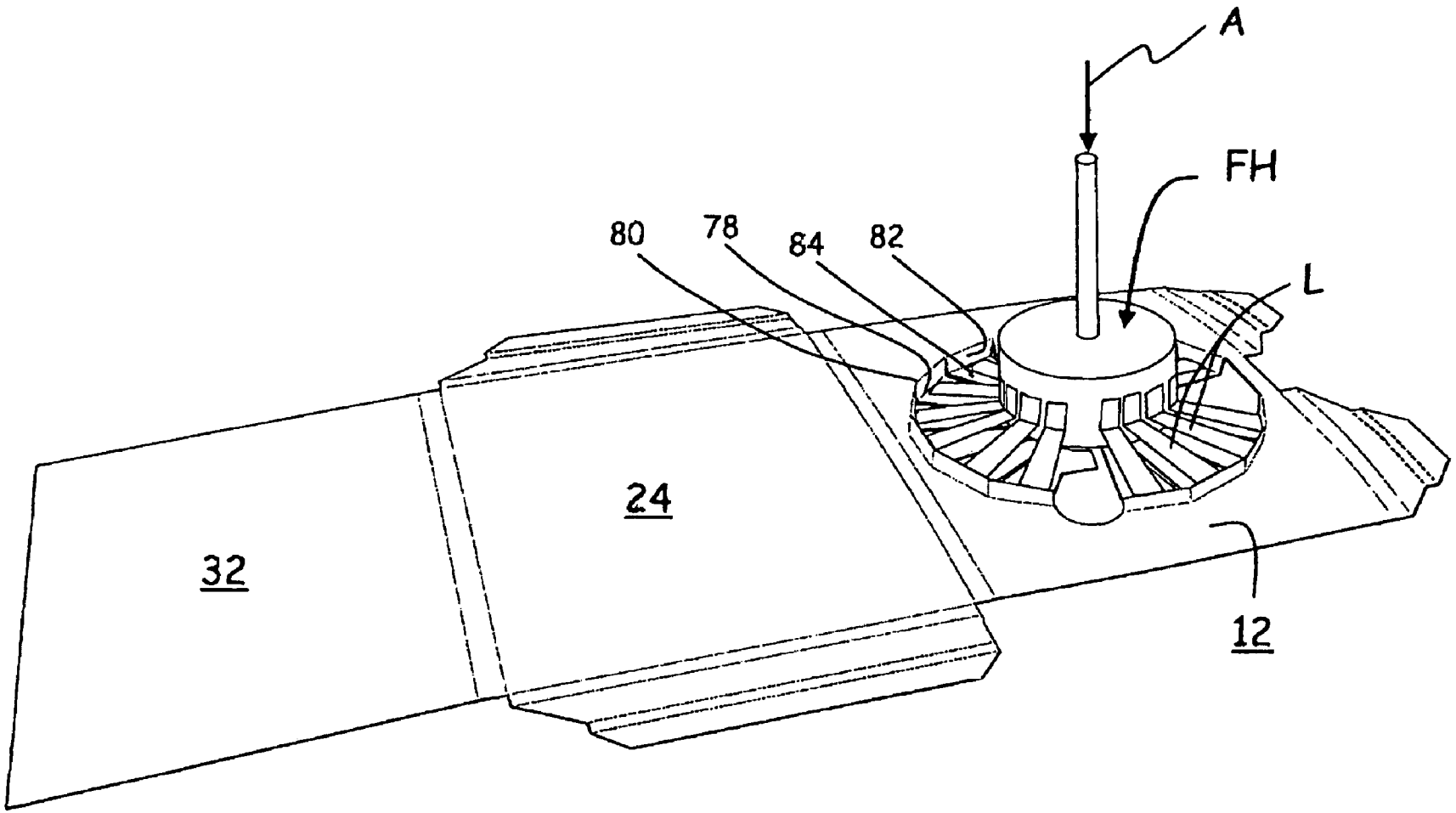
Figure 9:
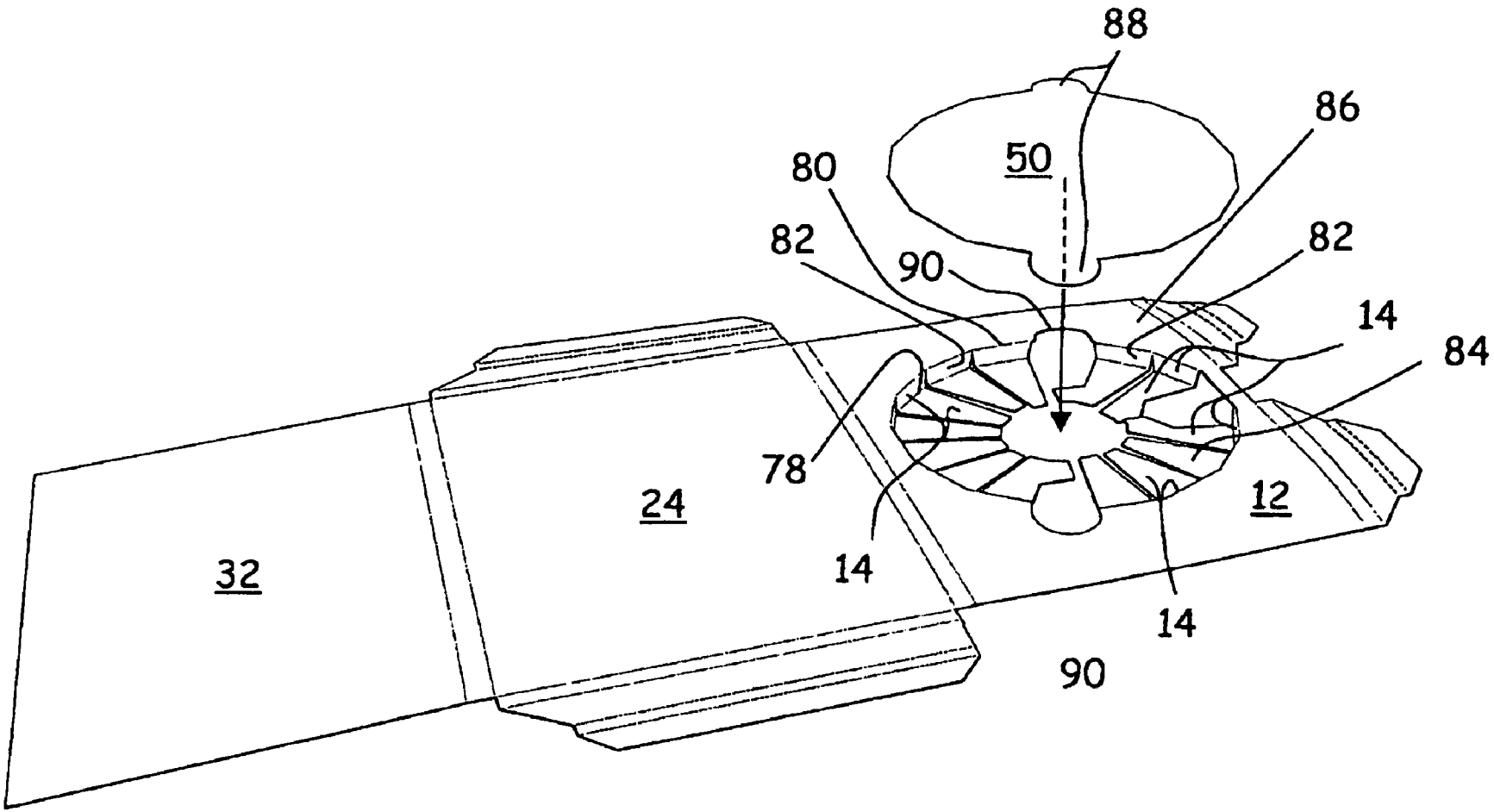
Figure 10:
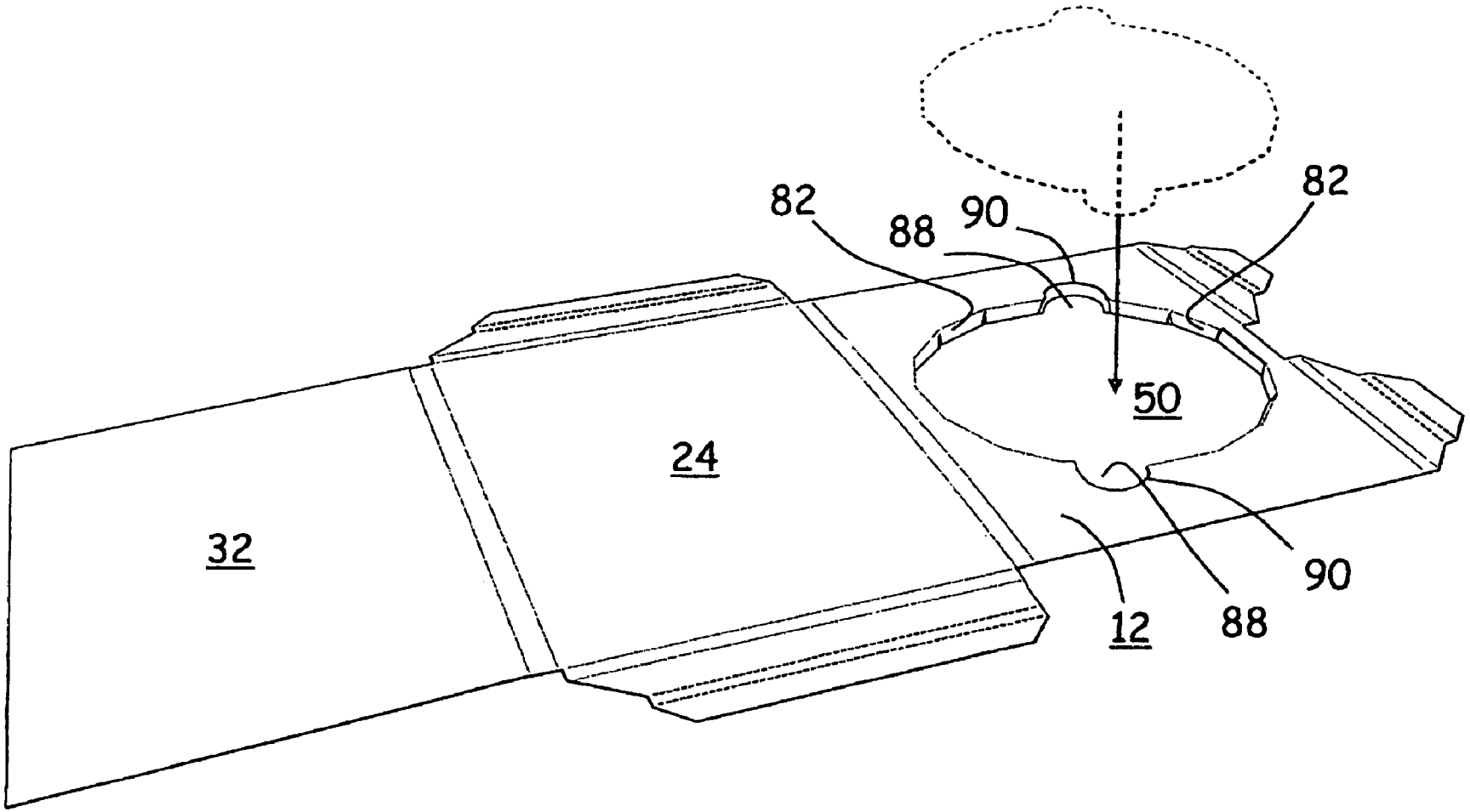
Figure 11:
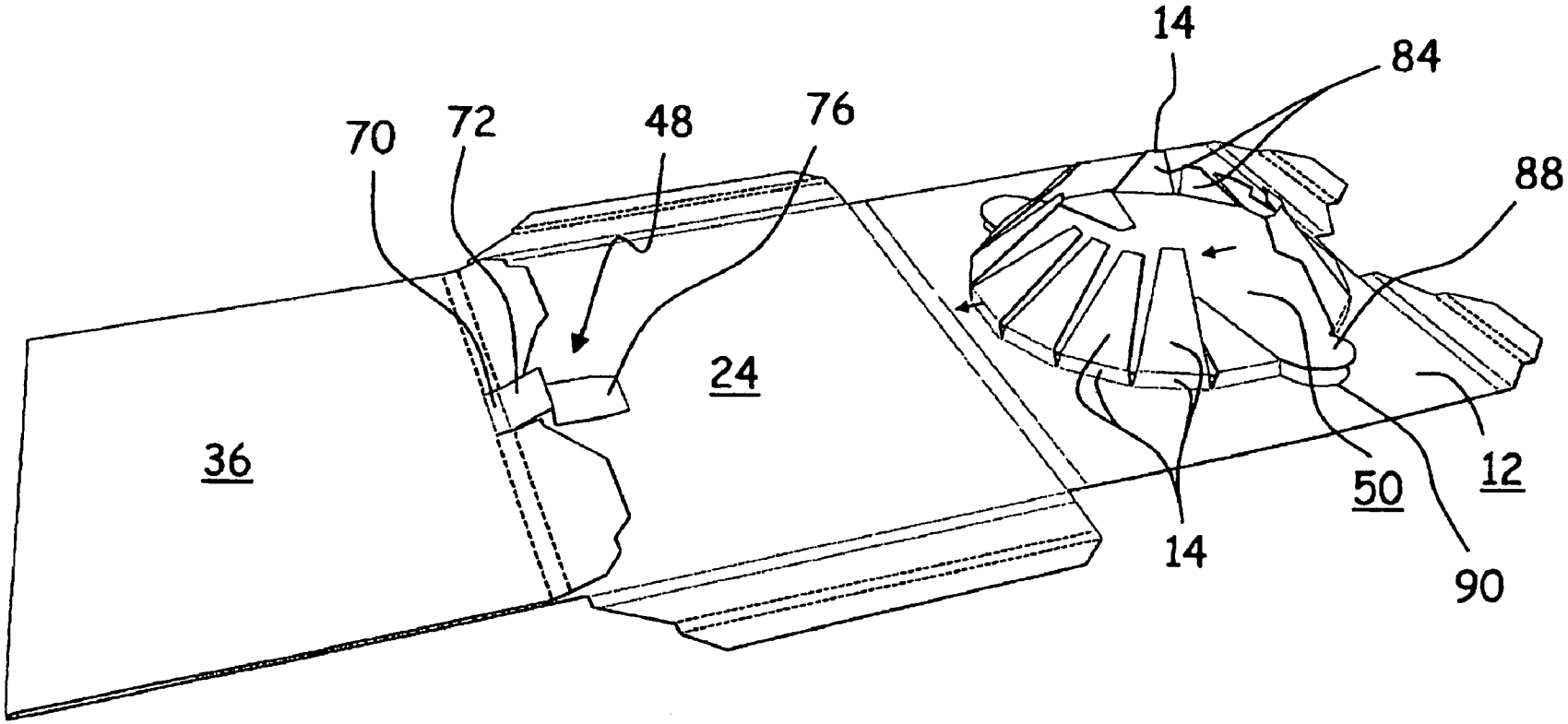
Figure 12:
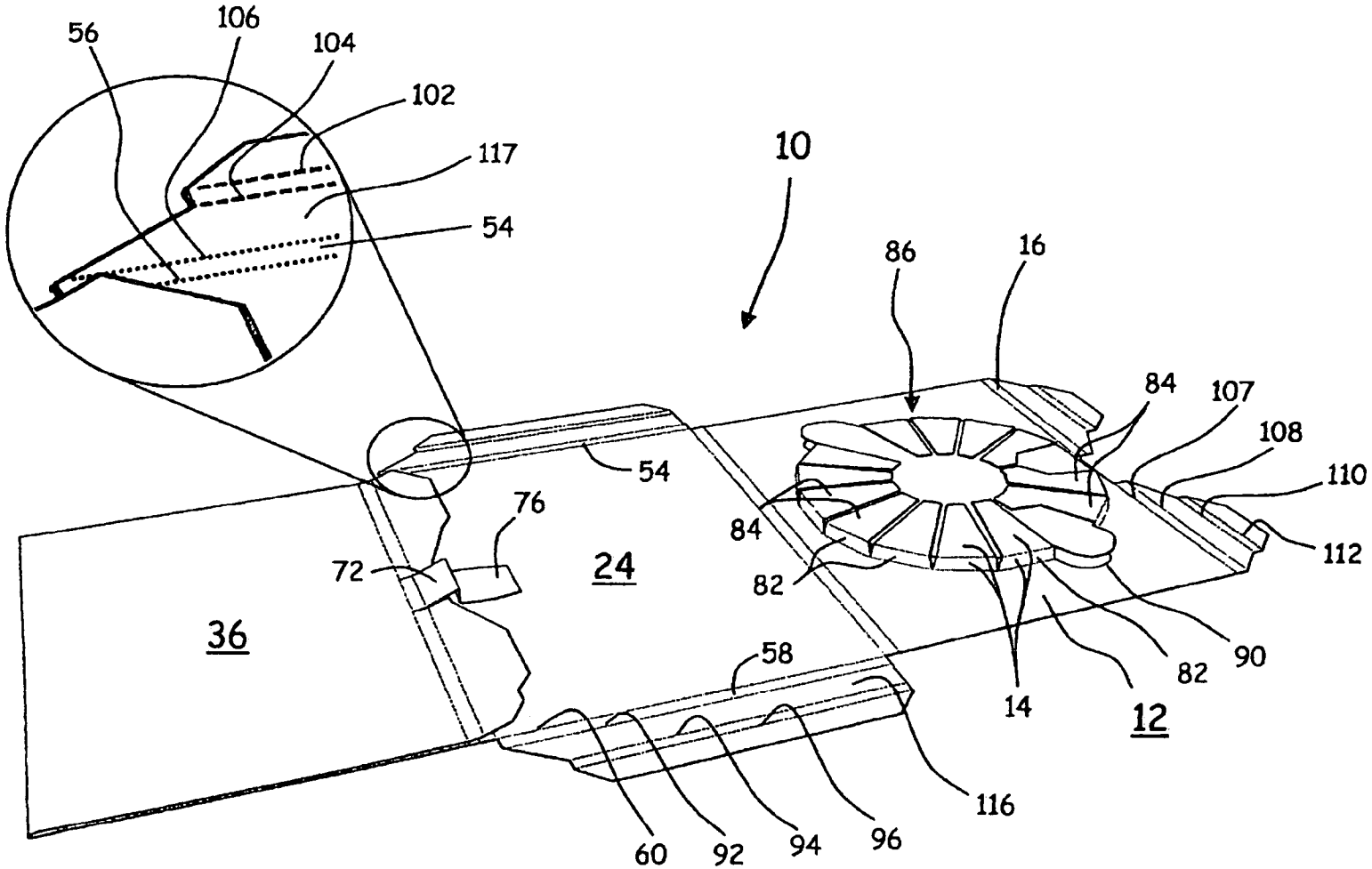
Figure 13:
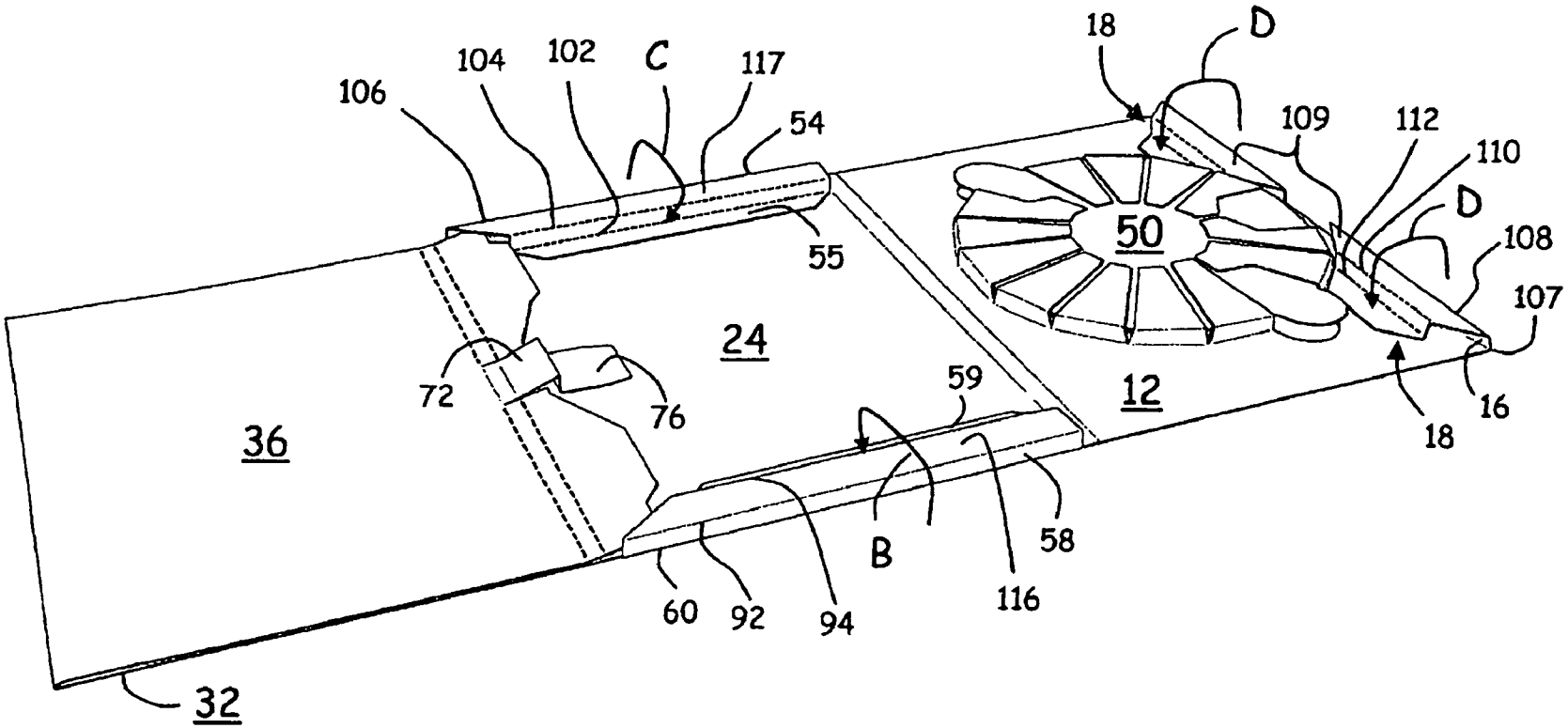

Next, the paperboard blank 10 is flipped over (see FIG. 6) in order to form a media well from the radially arrayed flaps 14. More specifically, as illustrated in FIGS. 7 and 8, a forming head FH, including a series of radially projecting fingers L, is aligned with and positioned over the radially arrayed flaps 14 and then displaced downwardly (note action arrow A) and outwardly. This serves to fold the flaps 14 along the crease lines 78 and 80 so as to form the sidewall 82 and bottom support 84 of the media well 86 (see also FIGS. 9 and 15). The bottom support 84 portion of the radially arrayed flaps 14 are temporarily held in position by vacuum or other means. The forming head FH is then removed and the media well reinforcement 50 is inserted over the portion of the flaps 14 forming the bottom support 84 of the media well 86. As illustrated, the tab(s) 88 on the reinforcement 50 are aligned and form the bottom of the finger notch(es) 90 that communicate with the media well 86. An adhesive is provided between the bottom support 84 and the media well reinforcement 50 in order to secure the media well reinforcement 50 in place within the sidewall 82 (see FIGS. 10 and 11). Once all of the bottom support sections 84 of the radially arrayed flaps 14 have been adhered to the media well reinforcement 50, the paperboard blank appears as illustrated in FIG. 12.

Next, (see FIGS. 12 and 13) the paperboard blank 10 is folded about the fold lines 60, 92 and nick perforations 94, 96 to erect the bottom wall 58 and bottom wall securing surface 116, and about the fold lines 56, 106 and the nick perforations 102, 104 to erect the top wall 54 and top wall securing surface 117. In addition, the first sidewall 16 is erected by folding the paperboard blank 10 about the fold lines 107, 108 and the nick perforations 110, 112 (note respective action arrows B, C and D) and first securing tab 18 is adhered to the rear face of media well panel 12. The top wall 54 and bottom wall 58 are secured in position by adhering the flaps 55, 59 to the interior face of the first cover panel 24.

Figure 14:
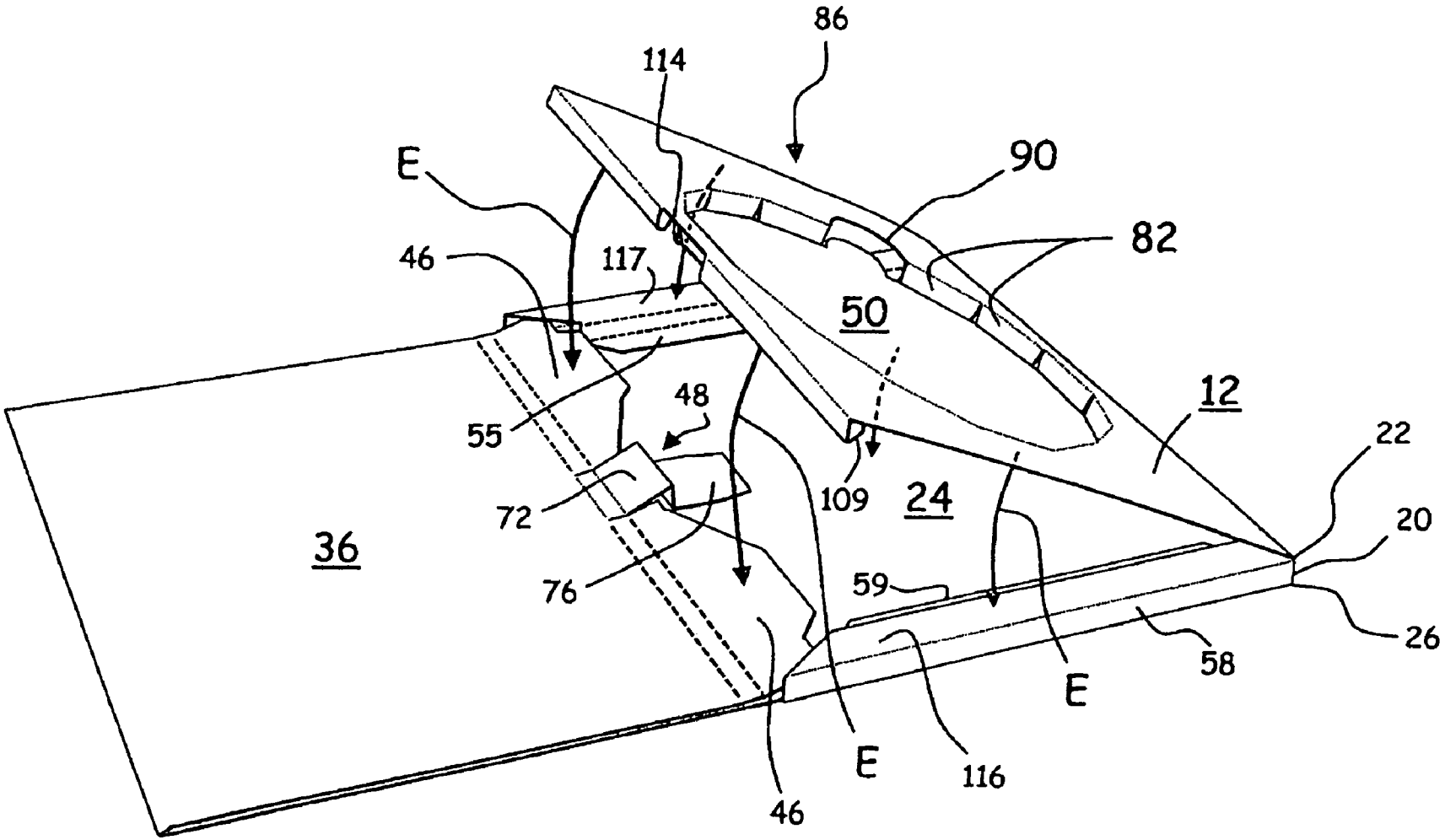

As best illustrated in FIG. 14, the next step is the erection of the second side wall panel 20 by folding the paperboard blank 10 along the fold lines 22, 26 (note action arrows E). As this is done the media well panel 12 is folded to overlie the inner face of the first cover panel 24. An opening 114 in the first side wall 16 provides sufficient clearance to accommodate the locking flap 48. When fully folded, the rear face of the media well panel 12 engages the top and bottom wall securing surfaces 117, 116 of the top and bottom walls 54, 58, and the bottom of the media well 86 abuts and is adhered to the inner face of the first cover panel 24. An adhesive on the top and bottom securing surfaces 117, 116 functions to adhere the media well panel 12 in the fully folded position. Simultaneously, the securing surface 109 of the first sidewall 16 is secured by adhesive to the second securing tab 46 between the media well panel 12 and the first cover panel 24. No adhesive is provided between the securing surfaces, tabs 109, 46 and the panels 12, 24 so that the tabs 46, although secured to surface 109, remain unsecured to the panels. The rear of the media well 86 is, however, simultaneously adhered with adhesive to the inner face of the first cover panel 24.

Figure 16:
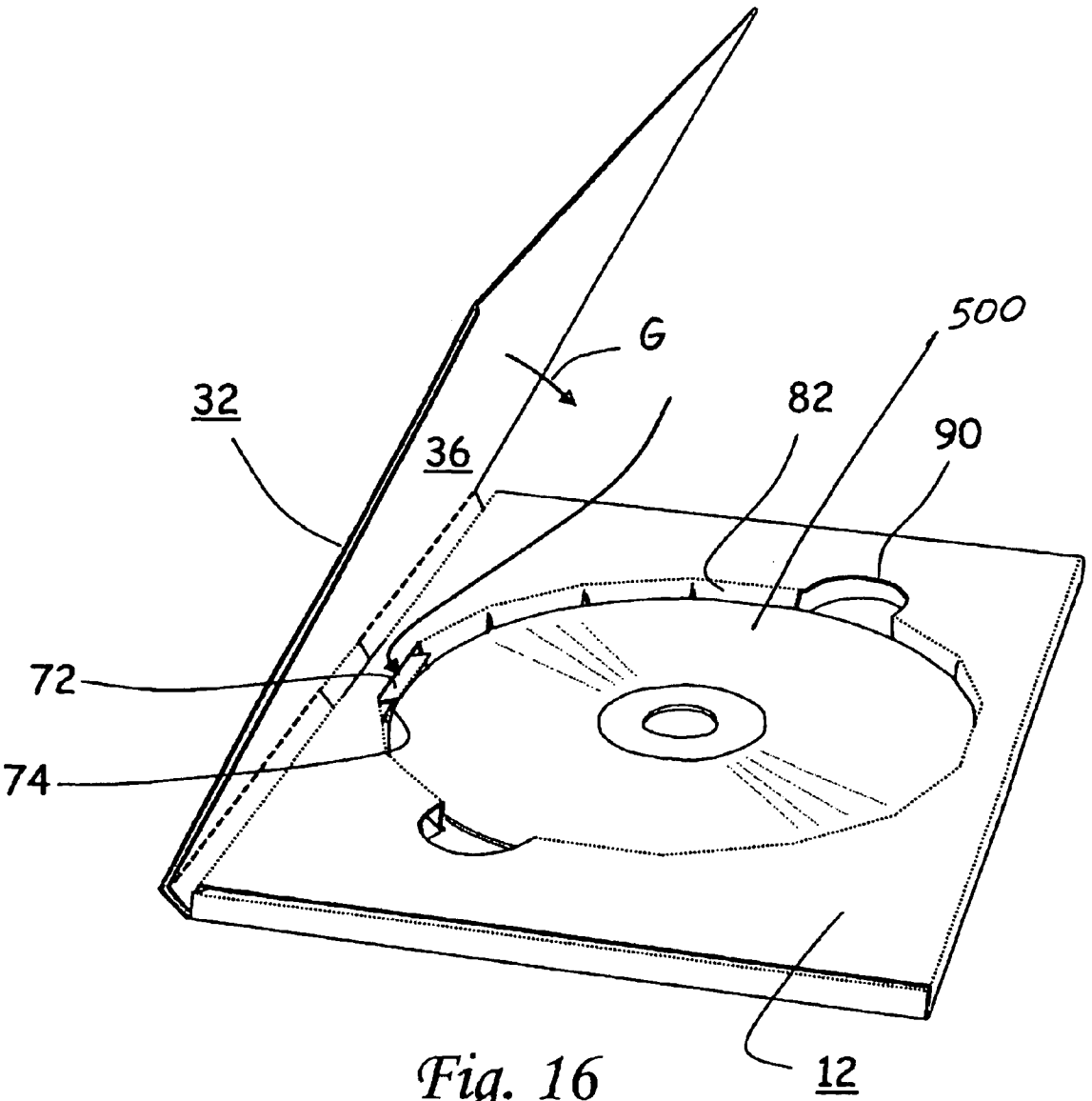
FIG. 16 is a perspective view illustrating the closing of the media package and the locking of the media disc in the media well.
Figure 17:
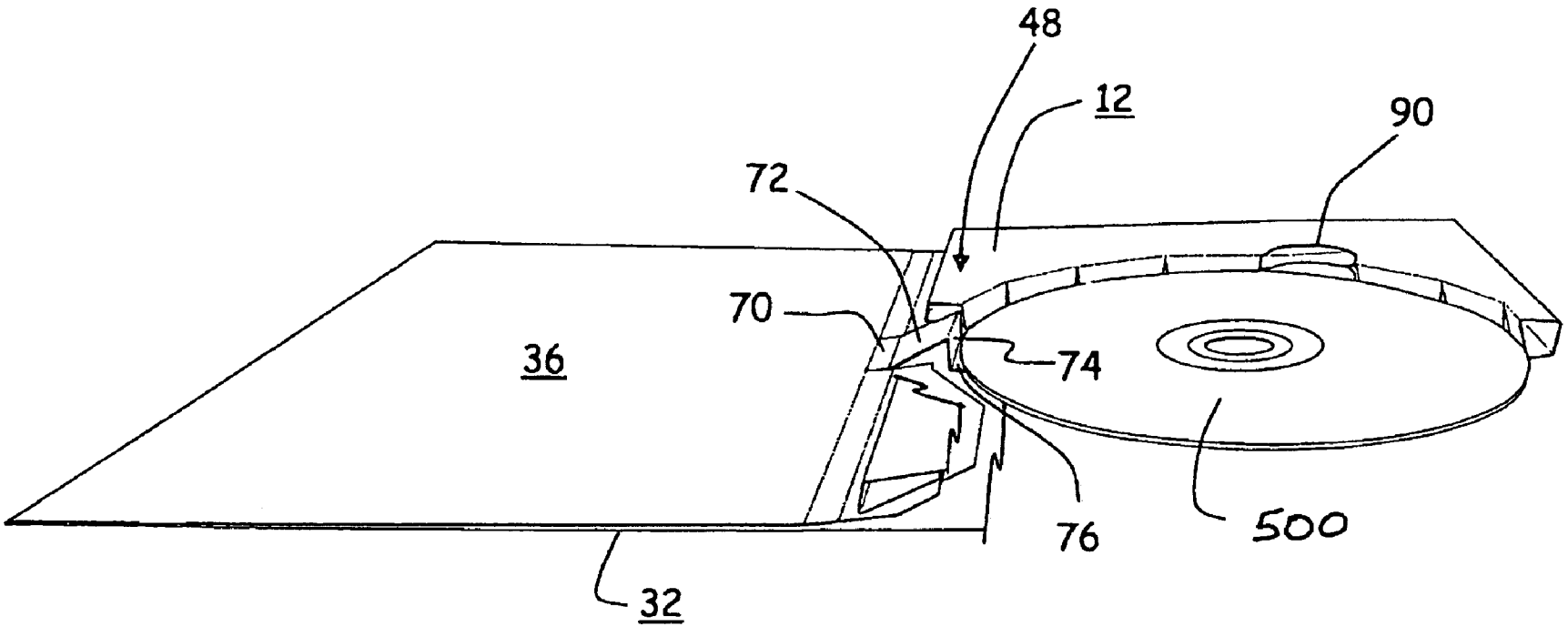
FIGS. 17 and 18 are partially cut away perspective views further illustrating the operation of the lock that secures the media disc in the media well when the media package is closed.
Figure 18:
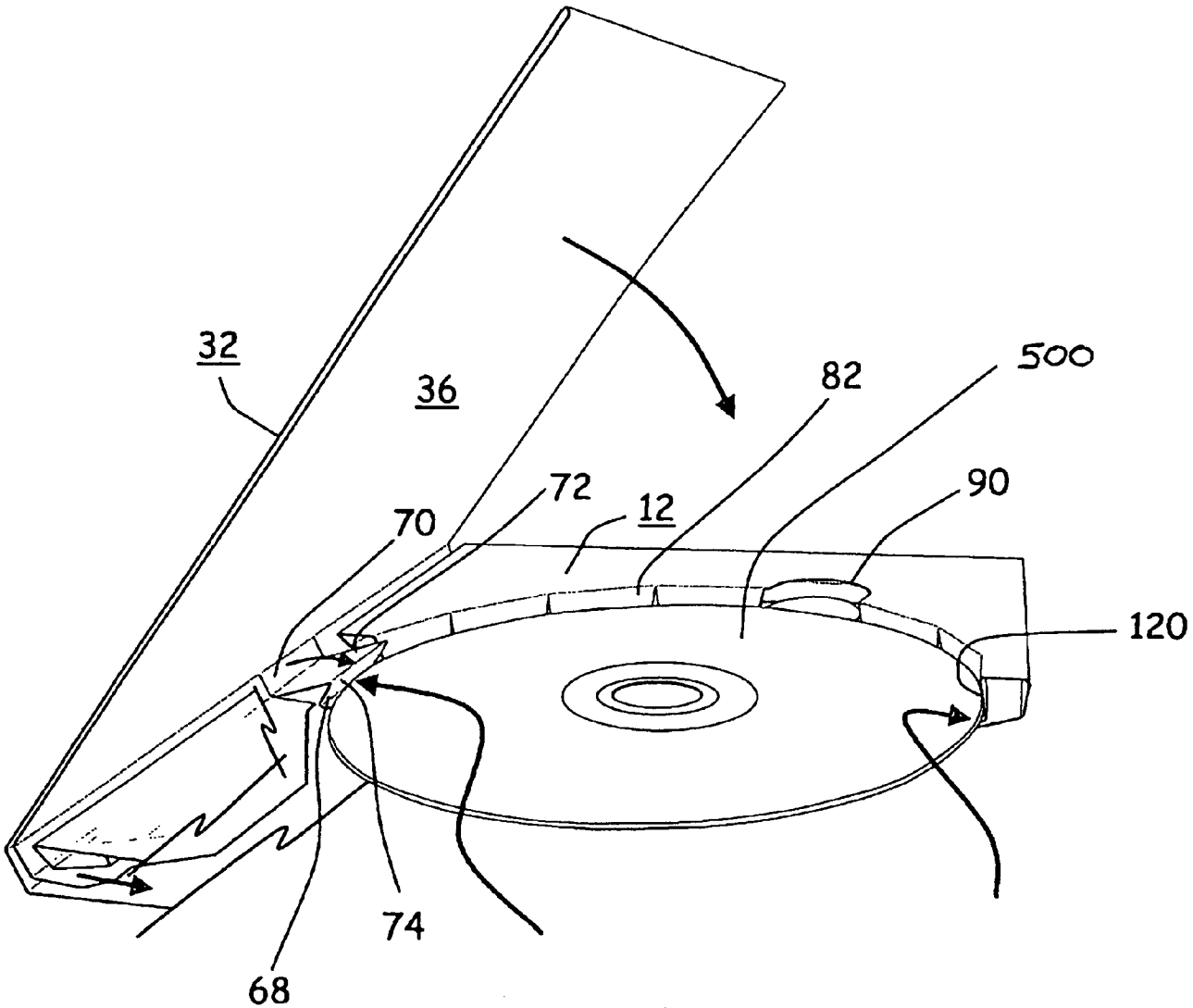

The fully constructed media package 100 is illustrated in FIG. 15 in the fully opened position. A media disc 500 is inserted in the media well 86 as illustrated by action arrow F. As illustrated in FIG. 16, when the second cover panel 32, 36 is closed (note action arrow G), the locking tab 72 is displaced the locked position wherein the tab 72 and extension section 74 overlie the media disc and positively holds the media disc within the media well 86. The operation of the locking flap 48 and more specifically the locking tab 72 and extension section 74 are best illustrated in FIGS. 17 and 18. When the second cover panel 32, 36 is in the fully opened position as illustrated in FIG. 17, the locking flap 48 extends through the opening 114 in the first side wall 16 so that the extension section 74 and mounting section 76 form an included angle of about 90 degrees. As should be appreciated, the extension section 74 functions as a portion of the sidewall 82 of the media well 86. In this retracted, substantially vertical position, the locking tab 72 does not interfere with (a) the positioning of a media disc 500 (CD, DVD, Blu-ray, Playstation, X-Box, or other pre-recorded or blank media disc) into the media well 86 or (b) the removal of a media disc from the media well by engaging the edge of the disc with a finger positioned in the finger notch 90. In contrast, when the second cover panel 32, 36 is closed as illustrated in FIG. 18, the locking flap 48 folds about the crease line 68 and the locking tab 72 and extension section 74 projects inwardly into the media well 86 so as to overlie the edge of the media disc 500. Simultaneously, the extension section 74 pushes the media disc 500 against the opposing wall 120 (the wall directly across from the locking flap 48), which is unique from the other wall 82 in that it slightly overlies the media disc. In this way, the media disc 500 is captured and held within the media well 86.

Several aspects of the construction of the media package 100 ensure the proper operation of the locking tab 72. More specifically, as noted above, the securing surfaces, tabs 109, 46, while adhered to each other, are not adhered to the first cover panel 24 or the media well panel 12. As a result, the spine support 40 is allowed to float inside the spine panel 28 and move as the second cover panel 32, 36 is opened and closed. In addition, the spine panel 28 has a width $W_1$ while the locking support 70 has a width $W_2$ between the main fold line 62 and the first crease line 64 where $W_1$ is greater than $W_2$. The floating spine support 40 functions with the geometry of the locking support 70 to move the locking tab 72 in an efficient and effective manner between the locked and unlocked positions as the cover panel 32, 36 is closed and opened.

Figure 19:
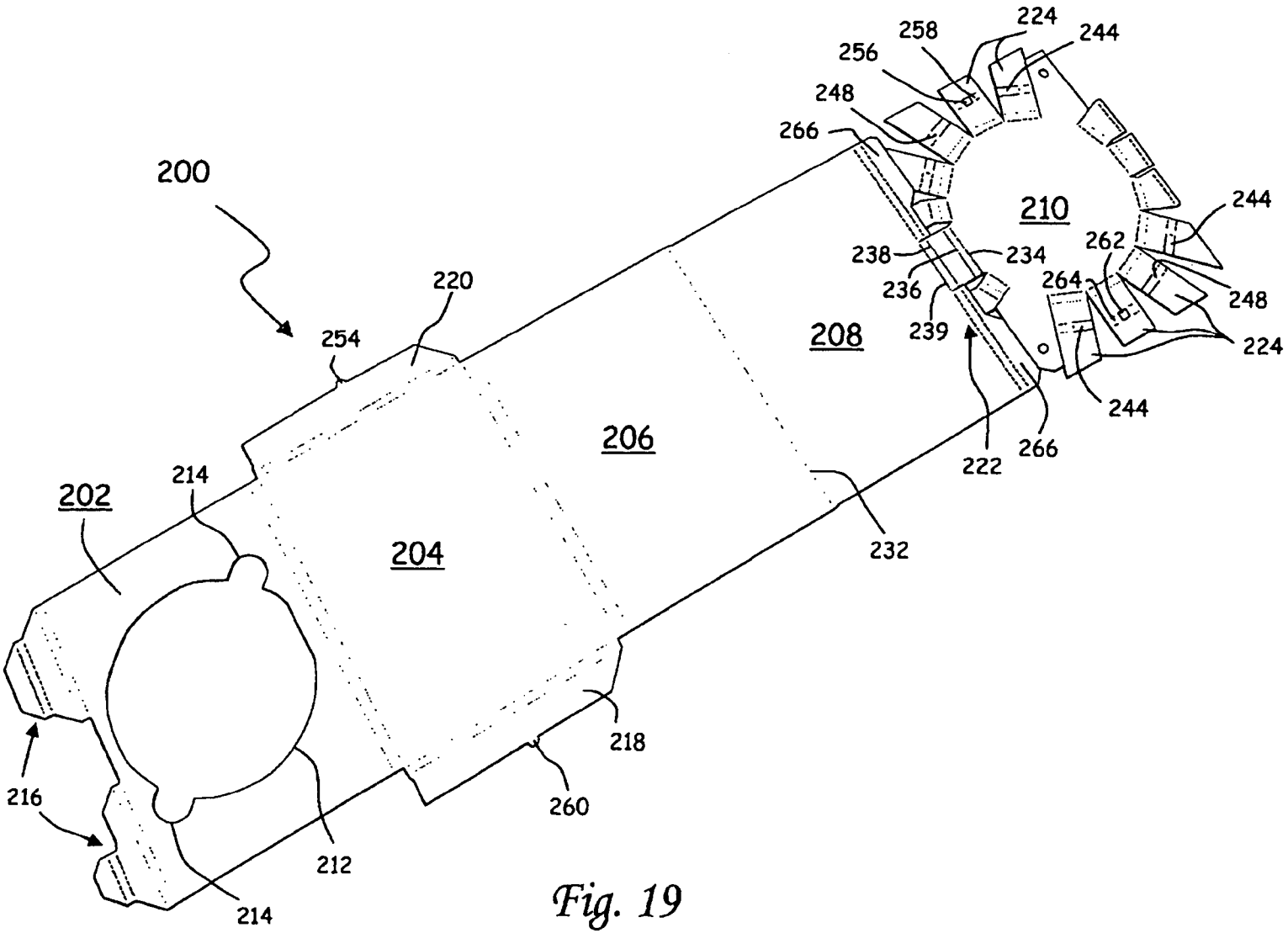
FIG. 19 is a perspective view of a paperboard blank which is used to construct an alternative embodiment of the media package of the present invention.
Figure 25:
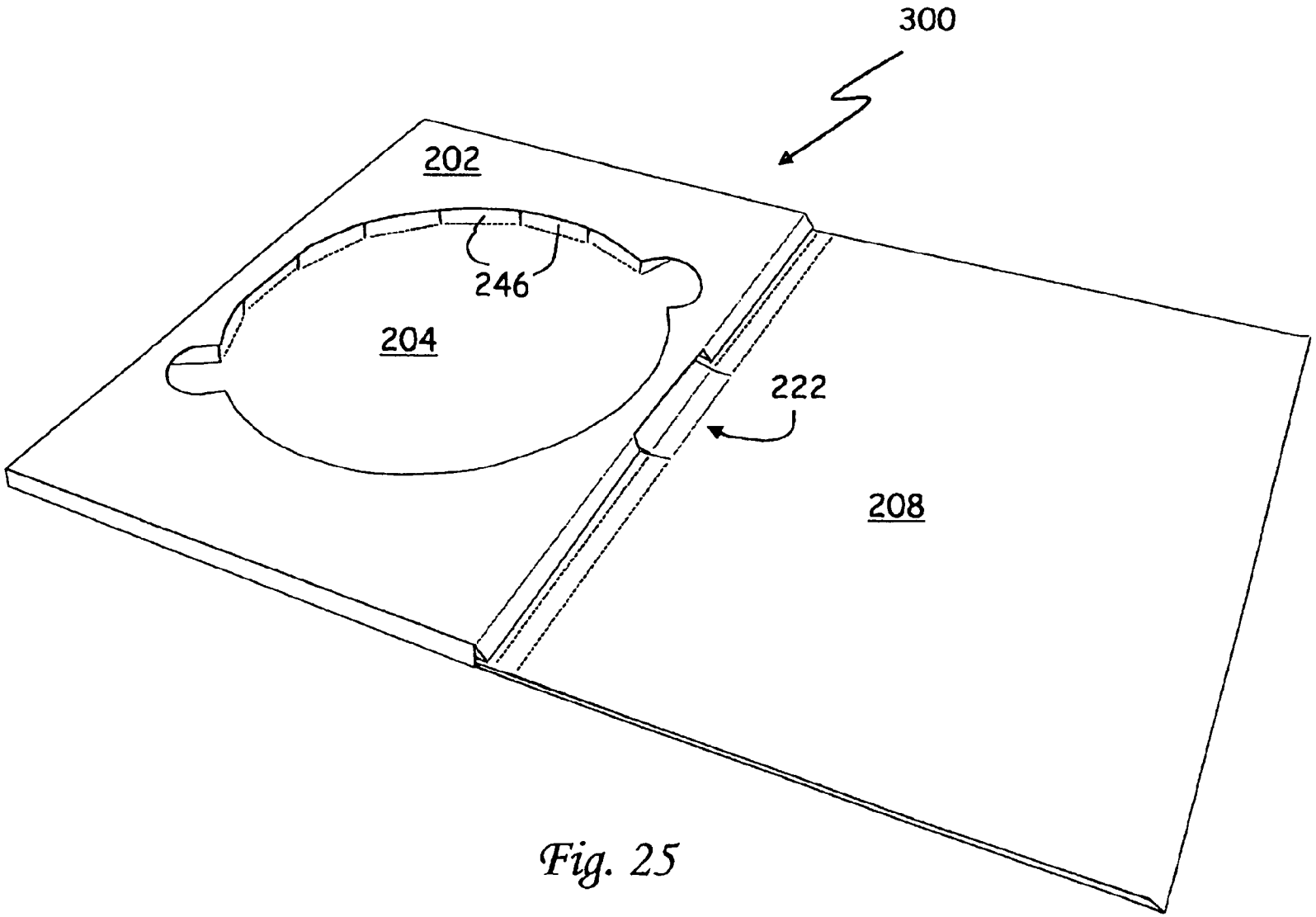
FIG. 25 is a perspective view illustrating the finished media package made from the paperboard blank illustrated in FIG. 19.

FIG. 19 illustrates a paperboard blank 200 for constructing an alternative embodiment of the media package 300 illustrated in FIG. 25. As illustrated in FIG. 19, the paperboard blank 200 includes five primary panels including: (a) a media well cover panel 202; (b) a rear cover panel 204; (c) a front cover panel 206; (d) a front cover support panel 208; and (e) a media well forming panel 210.

The media well cover panel 202 includes a media well opening 212 with at least one finger notch 214 (two are illustrated) and a pair of end wall and first securing tabs 216. The rear cover panel 204 includes a bottom wall panel 218 and a top wall panel 220. A locking flap 222 connects the media well forming panel 210 with the support panel 208 at main fold line 239.

Figure 20:
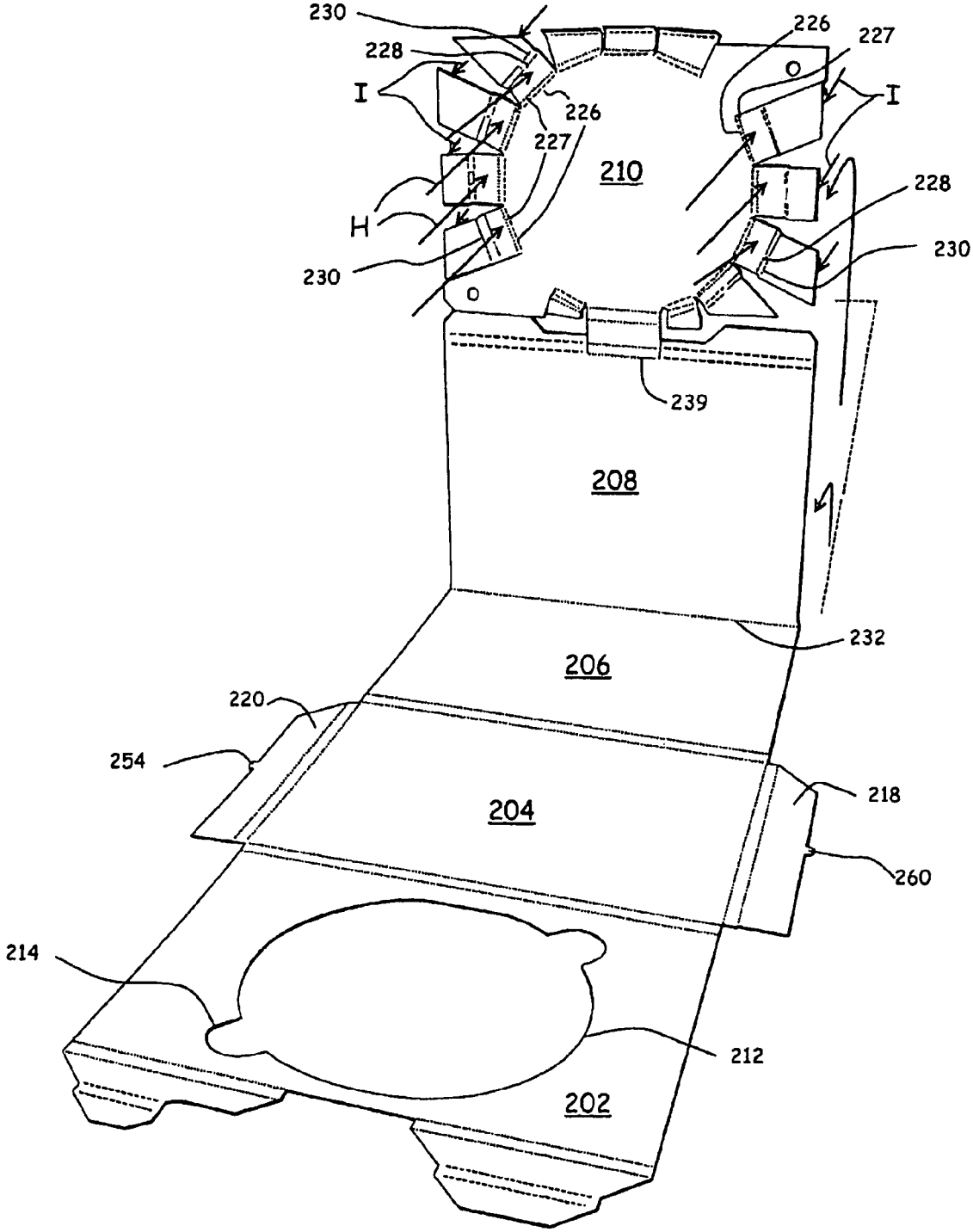
FIGS. 20-24 are perspective views providing step by step illustration of the construction of the media package from the paperboard blank illustrated in FIG. 19.
Figure 21:
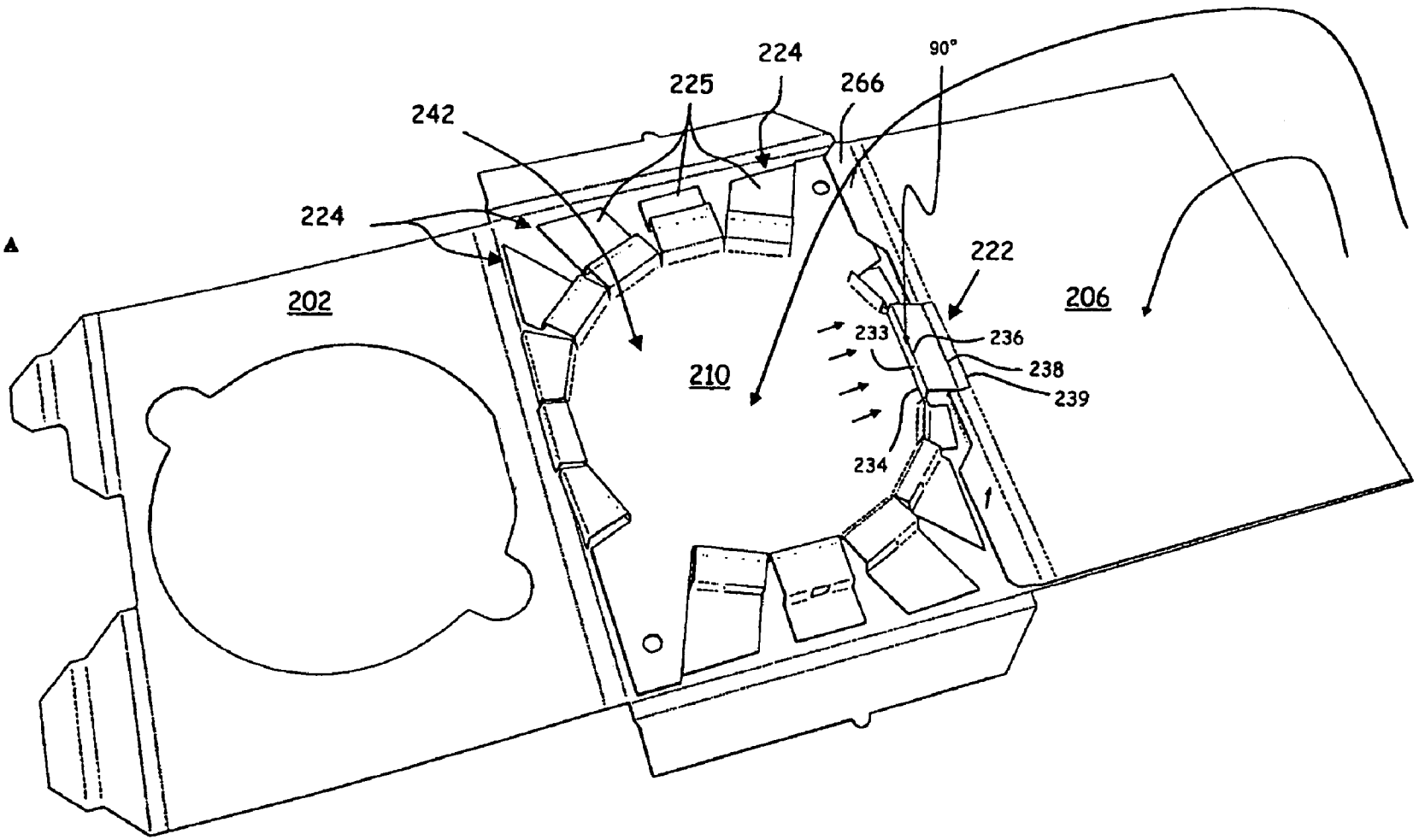
Figure 22:
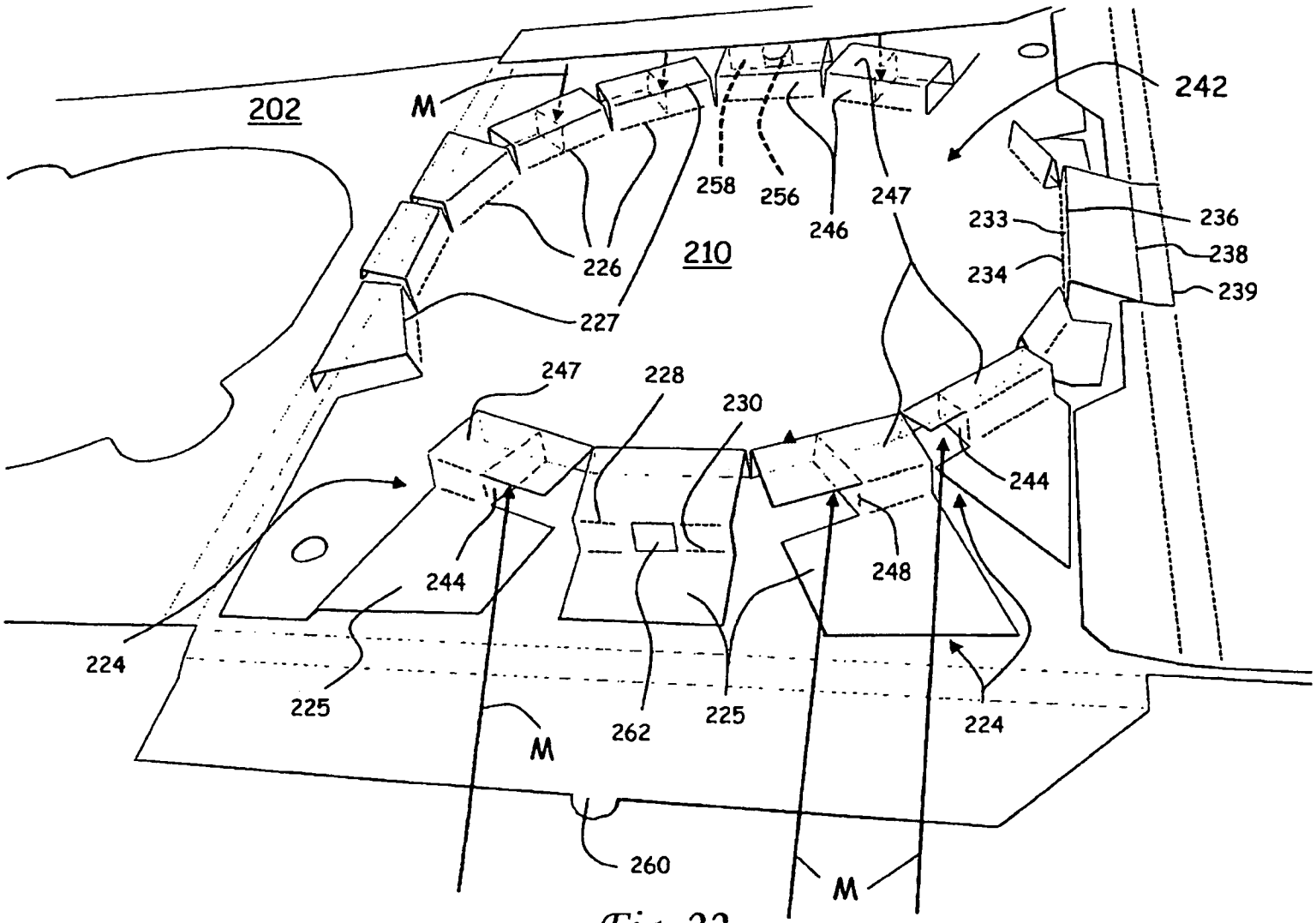

As best illustrated in FIGS. 19 and 20, the media well forming panel 210 includes a series of radially arrayed flaps 224. As illustrated in FIG. 20 the flaps 224 are folded about the crease lines 226, 227, 228 and 230 so as to form a media well 242, and simultaneously forming securing surfaces 247 for the well walls 246 (note FIG. 20 action arrows H and I, and FIG. 22 for a close-up view). Next, the paperboard blank 200 is folded along the fifth fold line 232 so that the front cover support panel 208 overlies the front cover panel 206 and those two panels are secured in abutting position by adhesive. As the paperboard blank 200 is folded about the fold line 232, the securing tabs 266 on the support panel 208 are folded upwardly (see FIG. 21).

Simultaneously, the locking flap 222 is then folded about the crease lines 234, 236, 238, and 239 and the media well forming panel 210 is secured to the rear cover panel 204 by means of adhesive on the bottom of the media well 242 and mounting tabs 225 of the radially arrayed flaps 224, in a position so that the extension section 233 of the locking flap 222 provides an included angle of about 90 degrees with the media well bottom 240 of the media well 242 when the front cover panel 206 is in the fully opened position. (see FIG. 21).

Next the struts 244 are folded inwardly beneath the securing surfaces 247 (note action arrows M) to support the well wall 246 erected from the folded radially arrayed flaps 224. This stabilizes the securing surfaces 247 for the well walls 246 (see FIG. 22). As illustrated, each of these struts 244 is folded about the fold line 248. Next the top and bottom securing surfaces 220 and 218 are erected. The top securing surface 220 includes a tab 254 that is received in the aperture 256 of the folded flap 258 while the bottom securing surface 218 includes a tab 260 that is received in the aperture 262 in the folded flap 264 (see FIG. 23). The top and bottom securing surfaces 218, 220 are held in position.

Figure 23:
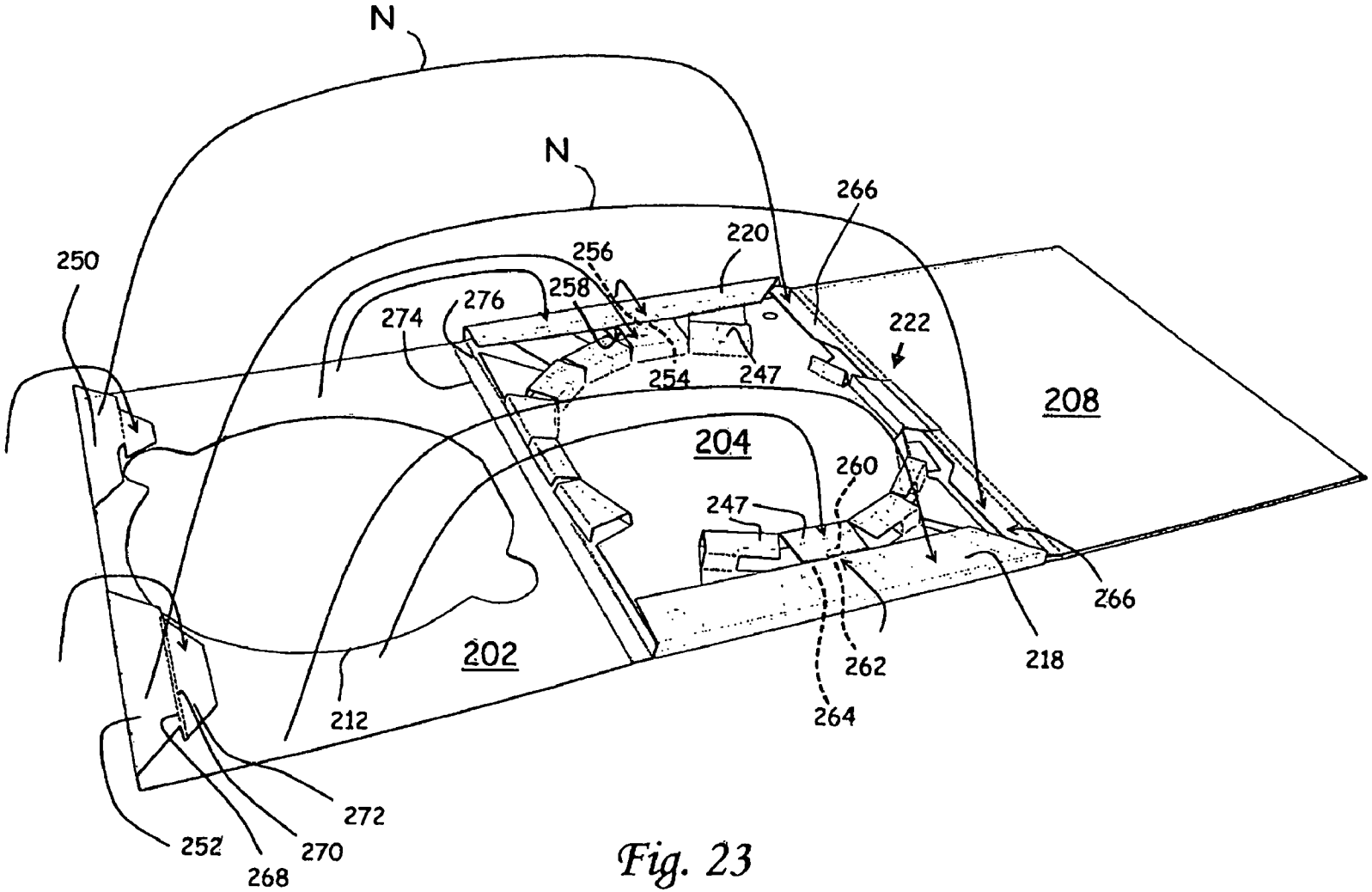
Figure 24:
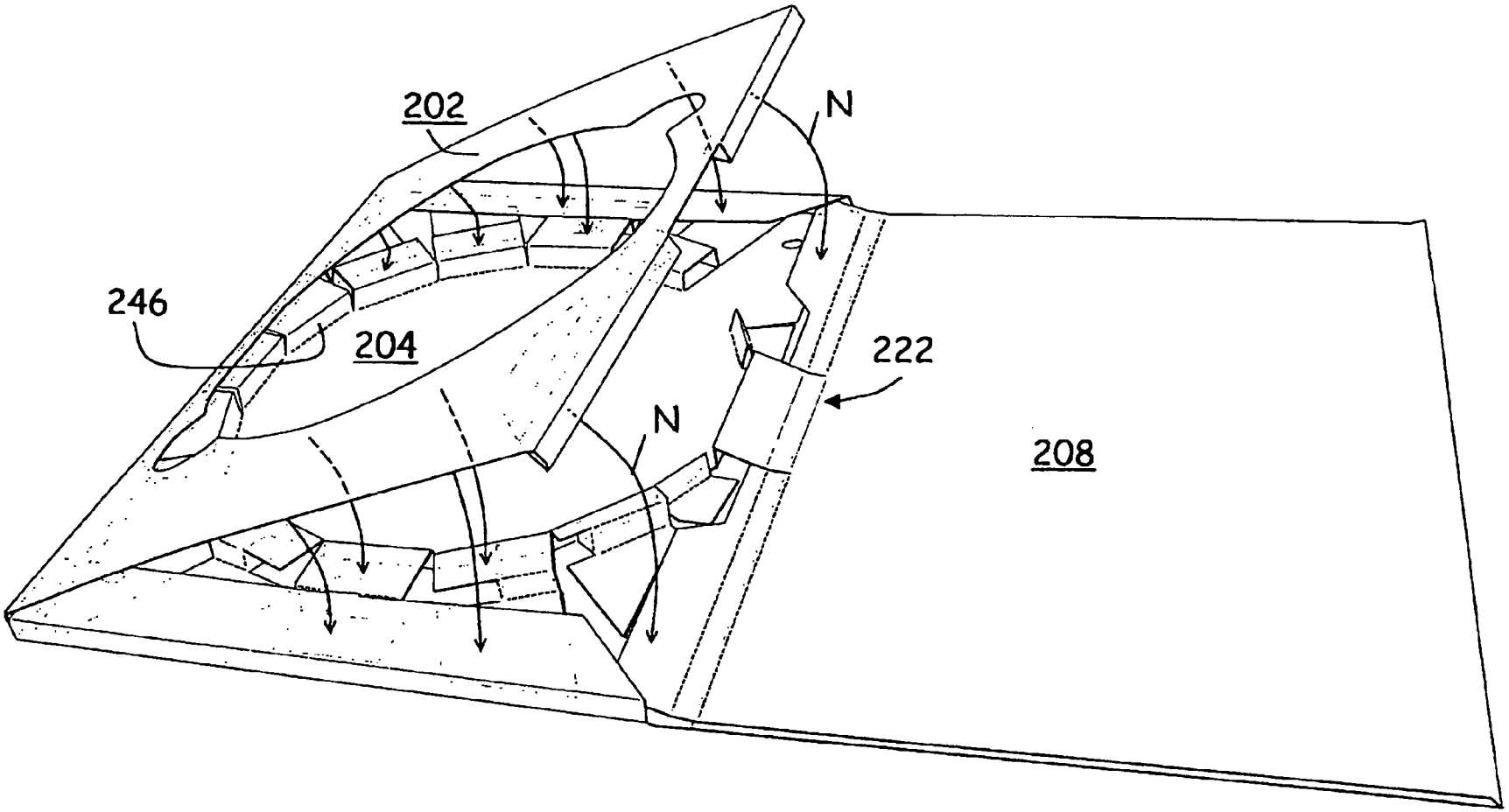

Next the securing tabs 216 on the media well cover panel 202 are now erected by folding about the nick perforations 268, 270 and securing the mounting flap 272 to the inside face of the media well cover panel by means of adhesive (again see FIG. 23). The paperboard blank 200 is then folded about the first and second fold lines 274, 276 so that the media well cover panel 202 is positioned overlying and adhered to the top securing surface 220 and bottom securing surface 218. Simultaneosly, media well cover panel 202 is adhered to the securing surfaces 247 of the media well radially arrayed flaps 224. Also, simultaneously the abutting faces of the securing surfaces 250, 252 and securing tabs 266 are adhered together with an adhesive (note action arrows N in drawing FIGS. 23 and 24). This completes the erection of the media package 300 which is illustrated in FIG. 25.

It should be appreciated that the locking flap 222 functions exactly like the locking flap 48 in the first embodiment. Thus, the locking flap 222 is displaceable between (a) a locked position wherein the lock engages the media disc to positively secure the media disc in the media well when the media package is closed and (b) an unlocked position wherein the media disc may be freely removed from the media well when the media package is open.

Numerous benefits result from employing the concepts of the present invention. The entire media package 100, 300, including the media well 86, 242 and the locking mechanism (not locking flap 48, 222 in the two embodiments) may be constructed from a single piece of paperboard. This eliminates any need to separately form and mate a media holder well with a separate package covering. It also allows the entire media package to be constructed from recycled paperboard while further making the media package more environmentally friendly and recyclable in and of its own right.

Significantly, all surfaces may be covered with media graphics to aid in the consumer presentation and marketing of the product. Further, it should be appreciated that as a result of the manner of folding the paperboard blank 10, 200, media printing is only required on one side of the paperboard to achieve this result. Thus, the media package 100, 300 is manufacturer friendly. This even includes the media holder well. Since all labels, bar codes and other required graphics may be printed directly onto the paperboard, no separate labeling steps and associated costs are incurred. By providing this unique list of advantages, the media package 100, 300 of the present invention clearly represents a significant advance in the art.

Figure 26:
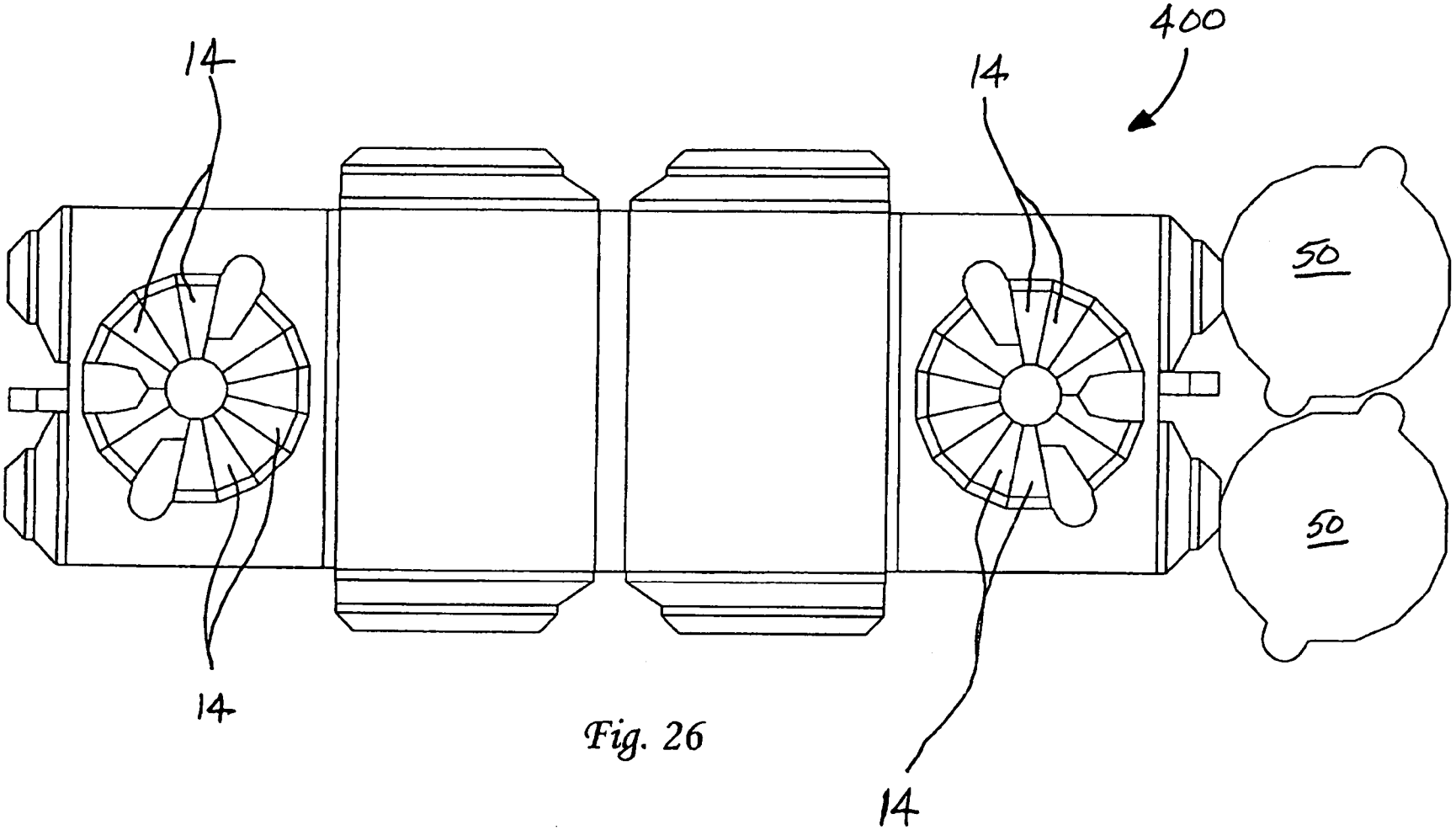
FIGS. 26 and 27 show two other possible alternative embodiments of the package illustrating that it can also be formed into a multi-disc package, or a package with a pouch for containing a booklet.
Figure 27:
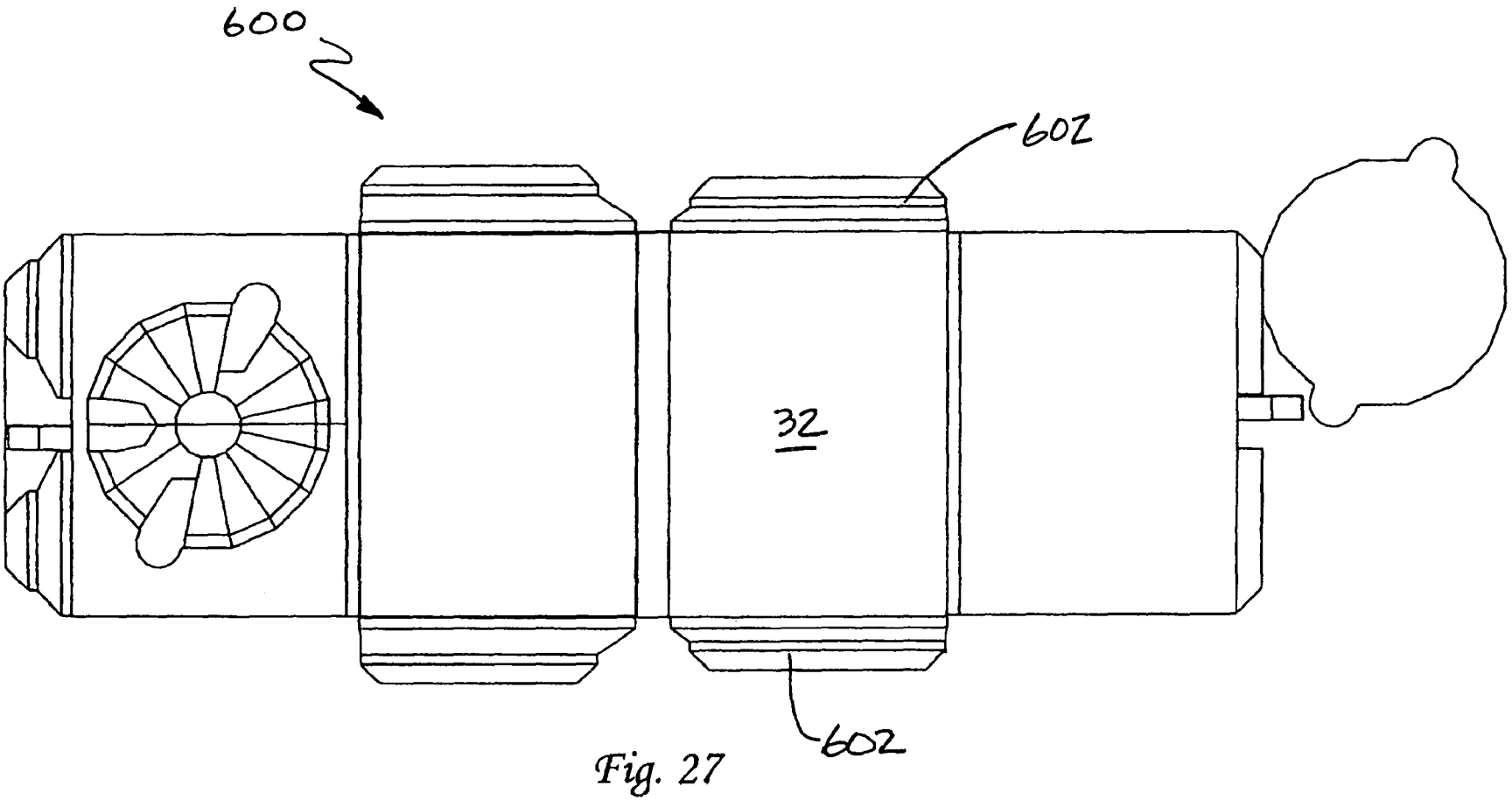

The foregoing description of the preferred embodiments of the present invention has been presented for purposes of illustration and description. It is not intended to be exhaustive or to limit the invention to the precise form disclosed. Obvious modifications or variations are possible in light of the above teachings. For example, FIG. 26 illustrates a paperboard blank 400 including two sets of radially arrayed flaps 14 and two media well reinforcements 50 for forming a media package with two media wells. Further, FIG. 27 shows a paperboard blank 600 with a front cover panel including flaps 602 for forming a pocket for holding a booklet or the like. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

What is claimed:

1. A paperboard media package for at least one media disc, comprising:

at least one media well panel including a media well, a first sidewall and a first securing tab;

a second sidewall panel connected to said media well panel by a first fold line;

a first cover panel connected to said second sidewall panel by a second fold line;

a spine panel connected to said first cover panel by a third fold line;

a second cover panel connected to said spine panel by a fourth fold line; and a second cover panel support panel including a spine support and a second securing tab, said second cover panel support panel carrying a lock that positively holds the media disc in said media well when said media package is closed;

wherein said lock is formed from a locking flap that includes a main fold line connecting said locking flap to said second cover panel support panel, a first crease line, a second crease line and a third crease line, a locking support formed between said main fold line and said first crease line, a locking tab formed between said first and second crease lines, an extension section formed between said second and third crease lines and a mounting section connected to said extension section by said third crease line, said locking flap being folded about said first, second and third crease lines and forming said lock.

2. The package of claim 1, wherein said mounting section is secured to an inside face of said first cover panel.

3. The package of claim 2, wherein said first sidewall includes an opening and said locking flap extends through said opening and engages the media disc in the media well when said media package is closed.

4. The package of claim 3, wherein said spine support abuts said spine panel, said spine panel having a width $W_1$ and said locking support having a width $W_2$ between said main fold line and said first crease line where $W_1>W_2$.

5. The package of claim 4, wherein said first securing tab is secured to said second securing tab between said media well panel and said first cover panel.

6. The package of claim 5, wherein said first and second securing tabs remain unsecured to said media well panel and said first cover panel.

7. The package of claim 1, wherein a top wall is connected to said first cover panel by a sixth fold line.

8. The package of claim 7, wherein a bottom wall is connected to said first cover panel by a seventh fold line.

9. The package of claim 8, wherein said media well panel includes a series of radially arrayed flaps that are folded to form said media well.

10. The package of claim 9, wherein said media well panel further includes at least one finger notch in communication with said media well to allow one to engage an edge of the media disc to extract the media disc from said media well.

11. The package of claim 10, further including a paperboard reinforcement received on said media well over said folded, radially arrayed flaps.

12. The package of claim 11, wherein said paperboard reinforcement fills a bottom of said media well and said at least one finger notch.

13. The package of claim 12, wherein said reinforcement is adhered into said bottom of said media well.

14. The package of claim 7, wherein said locking flap is displaceable between (a) a locked position wherein said locking tab and extension section engages the media disc to positively secure the media disc in said media well when said media package is closed and (b) an unlocked position wherein the media disc may be freely removed from said media well when said media package is opened.

15. The package of claim 14, wherein said locking tab folds over-center about said third crease line when said second cover panel is moved from a fully open position wherein said second cover panel is aligned with said first cover panel to a fully closed position wherein said second cover panel overlies said media well panel and said first cover panel.

16. A media package for holding at least one media disc, comprising:

a front cover;

a rear cover;

a spine connecting said front cover to said rear cover;

at least one media well carried by one of said front cover and said rear cover, said media well being sized and shaped to receive and hold the media disc; and a lock, displaceable between (a) a locked position wherein said lock engages the media disc to positively secure the media disc in said media well when said media package is closed and (b) an unlocked position wherein the media disc may be freely removed from said media well when said media package is opened;

said lock comprising a folding locking flap connected between said front cover and said rear cover, said folding locking flap including a locking support, a locking tab, an extension section and a mounting section, said locking support being connected to said locking tab by a first crease line, said locking tab being connected to said extension section by a second crease line and said extension section being connected to said mounting section by a third crease line whereby folding of said locking flap about said first, second and third crease lines erects said lock.

17. The media package of claim 16 wherein said media package and said lock are made from paperboard.

18. The media package of claim 16, wherein said media well is formed from folded, radially arrayed flaps of paperboard.

* * * * *